US011610549B2

(12) United States Patent
Yue et al.

(10) Patent No.: US 11,610,549 B2
(45) Date of Patent: Mar. 21, 2023

(54) PIXEL DRIVING CIRCUIT AND DRIVING METHOD THEREFOR, DISPLAY PANEL AND DISPLAY DEVICE

(71) Applicant: BOE TECHNOLOGY GROUP CO., LTD., Beijing (CN)

(72) Inventors: Han Yue, Beijing (CN); Dongni Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 36 days.

(21) Appl. No.: 17/603,686

(22) PCT Filed: Oct. 19, 2020

(86) PCT No.: PCT/CN2020/121912

§ 371 (c)(1),
(2) Date: Oct. 14, 2021

(87) PCT Pub. No.: WO2021/082970

PCT Pub. Date: May 6, 2021

(65) Prior Publication Data

US 2022/0157247 A1 May 19, 2022

(30) Foreign Application Priority Data

Nov. 1, 2019 (CN) ..... 201911061474.6

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/3258; G09G 3/3233; G09G 2300/0426; G09G 2300/0819;
(Continued)

(56) References Cited

U.S. PATENT DOCUMENTS 11,295,666 B2 * 4/2022 Jiang ..... G09G 3/3233
11,315,480 B2 * 4/2022 Liu ..... G09G 3/2022
(Continued)

*Primary Examiner* — Tom V Sheng
(74) *Attorney, Agent, or Firm* — IP & T Group LLP

(57) ABSTRACT

A pixel driving circuit includes a signal control sub-circuit and a time control sub-circuit. The signal control sub-circuit includes a first driving sub-circuit connected to a first node. The signal control sub-circuit is configured to: write at least a first data signal into the first node, and enable the first driving sub-circuit to output a driving signal according to the first data signal and a first power supply voltage signal. The time control sub-circuit includes a second driving sub-circuit including a first transistor connected to a second node and the signal control sub-circuit. The time control sub-circuit is configured to: transmit a second power supply voltage signal and a third power supply voltage signal to the second node in different periods, so as to control a turn-on time of the first transistor and transmit the driving signal to an element to be driven when the first transistor is turned on.

20 Claims, 10 Drawing Sheets

(52) U.S. Cl.
CPC ..... *G09G 2300/0819* (2013.01); *G09G 2300/0861* (2013.01); *G09G 2310/0278* (2013.01); *G09G 2310/061* (2013.01); *G09G 2310/08* (2013.01); *G09G 2320/0233* (2013.01); *G09G 2320/043* (2013.01); *G09G 2320/045* (2013.01)

(58) Field of Classification Search
CPC ... G09G 2300/0861; G09G 2310/0278; G09G 2310/061; G09G 2310/08; G09G 2320/0233; G09G 2320/043; G09G 2320/045
USPC ..... 345/204
See application file for complete search history.

(56) References Cited

U.S. PATENT DOCUMENTS

2011/0157126 A1* 6/2011 Chung ..... G09G 3/3233 345/76
2013/0300724 A1* 11/2013 Chaji ..... G09G 3/3258 345/212
2015/0062195 A1* 3/2015 Kumeta ..... G09G 3/3233 345/77
2016/0291743 A1* 10/2016 Yang ..... H01L 27/124
2017/0323599 A1* 11/2017 Chaji ..... G09G 3/3233
2018/0293929 A1* 10/2018 Shigeta ..... G09G 3/3233
2018/0336819 A1* 11/2018 Cai ..... G09G 3/3233
2018/0336820 A1* 11/2018 Cai ..... G09G 3/3233
2018/0336821 A1* 11/2018 Cai ..... G09G 3/3233
2019/0180677 A1* 6/2019 Hwang ..... G09G 3/3208
2019/0251902 A1* 8/2019 Qian ..... G09G 3/3266
2019/0371242 A1* 12/2019 Chaji ..... G09G 3/3258
2021/0090489 A1* 3/2021 Hung ..... G09G 3/2018
2021/0097931 A1* 4/2021 Yue ..... G09G 3/3283
2021/0201760 A1* 7/2021 Wang ..... G09G 3/3233
2021/0201773 A1* 7/2021 Liu ..... G09G 3/32
2021/0201790 A1* 7/2021 Gai ..... G09G 3/3233
2021/0225262 A1* 7/2021 Liu ..... G09G 3/2022
2021/0407376 A1* 12/2021 Yue ..... G09G 3/3233
2022/0076616 A1* 3/2022 Liu ..... G09G 3/3233
2022/0139322 A1* 5/2022 Wang ..... G09G 3/3241 345/690
2022/0215795 A1* 7/2022 Yue ..... G09G 3/2074
2022/0301500 A1* 9/2022 Shigeta ..... G09G 3/2074
2022/0319401 A1* 10/2022 Yue ..... G09G 3/32
2022/0319413 A1* 10/2022 Xuan ..... G09G 3/3275
2022/0383814 A1* 12/2022 Van Eessen ..... G09G 3/3233

* cited by examiner

PIXEL DRIVING CIRCUIT AND DRIVING METHOD THEREFOR, DISPLAY PANEL AND DISPLAY DEVICE

CROSS-REFERENCE TO RELATED APPLICATIONS

This application is a national phase entry under 35 USC 371 of International Patent Application No. PCT/CN2020/121912, filed on Oct. 19, 2020, which claims priority to Chinese Patent Application No. 201911061474.6, filed on Nov. 1, 2019, which are incorporated herein by reference in their entirety.

TECHNICAL FIELD

The present disclosure relates to the field of display technologies, and in particular, to a pixel driving circuit and a driving method therefor, a display panel and a display device.

BACKGROUND

Self-luminous devices have received wide attention due to their high luminance and wide color gamut. However, photoelectric conversion properties (for example, photoelectric conversion efficiency and color coordinates) of self-luminous devices will change as a current flowing through the self-luminous devices changes. For example, a luminous efficiency of a self-luminous device will decrease as a current density decreases.

SUMMARY

In one aspect, a pixel driving circuit is provided. The pixel driving circuit includes a signal control sub-circuit and a time control sub-circuit. The signal control sub-circuit is connected to a first scan signal terminal, a first data signal terminal, a first power supply voltage signal terminal, and an enable signal terminal. The signal control sub-circuit includes a first driving sub-circuit, and the first driving sub-circuit is connected to a first node. The signal control sub-circuit is configured to: write at least a first data signal provided by the first data signal terminal into the first node, in response to a first scan signal received from the first scan signal terminal; and enable the first driving sub-circuit to output a driving signal according to the first data signal provided by the first data signal terminal and a first power supply voltage signal provided by the first power supply voltage signal terminal, in response to an enable signal received from the enable signal terminal.

The time control sub-circuit is connected to a second scan signal terminal, a second data signal terminal, the enable signal terminal, a first voltage signal terminal, a second voltage signal terminal, a second power supply voltage signal terminal, a third power supply voltage signal terminal, the signal control sub-circuit and an element to be driven. The time control sub-circuit includes a second driving sub-circuit, and the second driving sub-circuit includes a first transistor. The second driving sub-circuit is connected to a second node, a third node, and a fourth node. The first transistor is connected to the second node and the signal control sub-circuit. The time control sub-circuit is configured to: write a second data signal provided by the second data signal terminal into the fourth node, and write a second voltage signal provided by the second voltage signal terminal into the third node, in response to a second scan signal received from the second scan signal terminal; write a first voltage signal that changes within a set voltage range provided by the first voltage signal terminal into the fourth node, in response to the enable signal from the enable signal terminal, so that a voltage on the third node changes as a voltage difference between the first voltage signal and the second data signal changes; and transmit a second power supply voltage signal provided by the second power supply voltage signal terminal and a third power supply voltage signal provided by the third power supply voltage signal terminal to the second node in different periods, in response to a change of the voltage on the third node, so as to control a turn-on time of the first transistor, and transmit the driving signal to the element to be driven when the first transistor is turned on.

In some embodiments, the signal control sub-circuit further includes a first data writing sub-circuit and a first control sub-circuit. The first driving sub-circuit includes a driving transistor, and a gate of the driving transistor is connected to the first node. The first data writing sub-circuit is connected to the first scan signal terminal, the first data signal terminal, and the driving transistor. The first data writing sub-circuit is configured to write the first data signal and a threshold voltage of the driving transistor into the first node, in response to the received first scan signal, so as to perform threshold voltage compensation on the driving transistor. The first control sub-circuit is connected to the enable signal terminal, the first power supply voltage signal terminal, the driving transistor, and a first electrode of the first transistor. The first control sub-circuit is configured to enable the driving transistor to be connected to the first power supply voltage signal terminal and the first electrode of the first transistor, in response to the received enable signal. The first driving sub-circuit is further connected to the first power supply voltage signal terminal. The driving transistor is configured to output the driving signal to the first electrode of the first transistor according to the first data signal and the first power supply voltage signal.

In some embodiments, the first driving sub-circuit further includes a first capacitor. One terminal of the first capacitor is connected to the first power supply voltage signal terminal, and another terminal of the first capacitor is connected to the first node.

In some embodiments, the first data writing sub-circuit includes a second transistor and a third transistor. A gate of the second transistor is connected to the first scan signal terminal, a first electrode of the second transistor is connected to a second electrode of the driving transistor, and a second electrode of the second transistor is connected to the first node. A gate of the third transistor is connected to the first scan signal terminal, a first electrode of the third transistor is connected to the first data signal terminal, and a second electrode of the third transistor is connected to a first electrode of the driving transistor.

In some embodiments, the first control sub-circuit includes a fourth transistor and a fifth transistor. A gate of the fourth transistor is connected to the enable signal terminal, a first electrode of the fourth transistor is connected to the first power supply voltage signal terminal, and a second electrode of the fourth transistor is connected to the first electrode of the driving transistor. A gate of the fifth transistor is connected to the enable signal terminal, a first electrode of the fifth transistor is connected to the second electrode of the driving transistor, and a second electrode of the fifth transistor is connected to the first electrode of the first transistor.

In some embodiments, the signal control sub-circuit further includes a reset sub-circuit. The reset sub-circuit is connected to an initial signal terminal, a reset signal terminal and the first node. The reset sub-circuit is configured to transmit an initial signal provided by the initial signal terminal to the first node, in response to a reset signal received from the reset signal terminal.

In some embodiments, the reset sub-circuit includes a sixth transistor. A gate of the sixth transistor is connected to the reset signal terminal, a first electrode of the sixth transistor is connected to the initial signal terminal, and a second electrode of the sixth transistor is connected to the first node.

In some embodiments, the time control sub-circuit further includes a second data writing sub-circuit, a second control sub-circuit, and a potential control sub-circuit. The second driving sub-circuit further includes a second capacitor. A gate of the first transistor is connected to the second node, and a first electrode of the first transistor is connected to the signal control sub-circuit. One terminal of the second capacitor is connected to the third node, and another terminal of the second capacitor is connected to the fourth node. The second data writing sub-circuit is connected to the second scan signal terminal, the second data signal terminal, the second voltage signal terminal, the third node, and the fourth node. The second data writing sub-circuit is configured to write the second data signal into the fourth node and write the second voltage signal into the third node, in response to the received second scan signal. The second control sub-circuit is connected to the enable signal terminal, the first voltage signal terminal, a second electrode of the first transistor, the fourth node, and the element to be driven. The second control sub-circuit is configured to write the first voltage signal into the fourth node, and enable the second electrode of the first transistor to be connected to the element to be driven, in response to the received enable signal. The potential control sub-circuit is connected to the second node, the third node, the second power supply voltage signal terminal and the third power supply voltage signal terminal. The potential control sub-circuit is configured to transmit the second power supply voltage signal and the third power supply voltage signal to the second node in different periods, in response to the change of the voltage on the third node.

In some embodiments, the second data writing sub-circuit includes a seventh transistor and an eighth transistor. A gate of the seventh transistor is connected to the second scan signal terminal, a first electrode of the seventh transistor is connected to the second data signal terminal, and a second electrode of the seventh transistor is connected to the fourth node. A gate of the eighth transistor is connected to the second scan signal terminal, a first electrode of the eighth transistor is connected to the second voltage signal terminal, and a second electrode of the eighth transistor is connected to the third node.

In some embodiments, the second control sub-circuit includes a ninth transistor and a tenth transistor. A gate of the ninth transistor is connected to the enable signal terminal, a first electrode of the ninth transistor is connected to the first voltage signal terminal, and a second electrode of the ninth transistor is connected to the fourth node. A gate of the tenth transistor is connected to the enable signal terminal, a first electrode of the tenth transistor is connected to the second electrode of the first transistor, and a second electrode of the tenth transistor is connected to the element to be driven.

In some embodiments, the potential control sub-circuit includes an eleventh transistor, a twelfth transistor, a thirteenth transistor, a fourteenth transistor, a fifteenth transistor, and a sixteenth transistor. A gate of the eleventh transistor is connected to the third node, a first electrode of the eleventh transistor is connected to the second power supply voltage signal terminal, and a second electrode of the eleventh transistor is connected to a first electrode of the twelfth transistor. A gate of the twelfth transistor is connected to the third node, and a second electrode of the twelfth transistor is connected to the second node. A gate of the thirteenth transistor is connected to the third node, a first electrode of the thirteenth transistor is connected to the third power supply voltage signal terminal, and a second electrode of the thirteenth transistor is connected to a first electrode of the fourteenth transistor. A gate of the fourteenth transistor is connected to the third node, and a second electrode of the fourteenth transistor is connected to the second node. A gate of the fifteenth transistor is connected to the second node, a first electrode of the fifteenth transistor is connected to the third power supply voltage signal terminal, and a second electrode of the fifteenth transistor is connected to the second electrode of the eleventh transistor and the first electrode of the twelfth transistor. A gate of the sixteenth transistor is connected to the second node, a first electrode of the sixteenth transistor is connected to the second power supply voltage signal terminal, and a second electrode of the sixteenth transistor is connected to the second electrode of the thirteenth transistor and the first electrode of the fourteenth transistor. The eleventh transistor, the twelfth transistor, and the fifteenth transistor are all P-type transistors, and the thirteenth transistor, the fourteenth transistor, and the sixteenth transistor are all N-type transistors. Or, the eleventh transistor, the twelfth transistor, and the fifteenth transistor are all N-type transistors, and the thirteenth transistor, the fourteenth transistor, and the sixteenth transistor are all P-type transistors.

The signal control sub-circuit further includes a first data writing sub-circuit and a first control sub-circuit. The first driving sub-circuit includes a driving transistor and a first capacitor; a gate of the driving transistor is connected to the first node; one terminal of the first capacitor is connected to the first power supply voltage signal terminal, and another terminal of the first capacitor is connected to the first node. The first data writing sub-circuit includes a second transistor and a third transistor; a gate of the second transistor is connected to the first scan signal terminal, a first electrode of the second transistor is connected to a second electrode of the driving transistor, and a second electrode of the second transistor is connected to the first node; a gate of the third transistor is connected to the first scan signal terminal, a first electrode of the third transistor is connected to the first data signal terminal, and a second electrode of the third transistor is connected to a first electrode of the driving transistor. The first control sub-circuit includes a fourth transistor and a fifth transistor; a gate of the fourth transistor is connected to the enable signal terminal, a first electrode of the fourth transistor is connected to the first power supply voltage signal terminal, and a second electrode of the fourth transistor is connected to the first electrode of the driving transistor; and a gate of the fifth transistor is connected to the enable signal terminal, a first electrode of the fifth transistor is connected to the second electrode of the driving transistor, and a second electrode of the fifth transistor is connected to the first electrode of the first transistor.

The time control sub-circuit further includes a second data writing sub-circuit, a second control sub-circuit, and a potential control sub-circuit. The second driving sub-circuit further includes a second capacitor; a gate of the first transistor is connected to the second node, and a first electrode of the first transistor is connected to the signal control sub-circuit; one terminal of the second capacitor is connected to the third node, and another terminal of the second capacitor is connected to the fourth node. The second data writing sub-circuit includes a seventh transistor and an eighth transistor; a gate of the seventh transistor is connected to the second scan signal terminal, a first electrode of the seventh transistor is connected to the second data signal terminal, and a second electrode of the seventh transistor is connected to the fourth node; a gate of the eighth transistor is connected to the second scan signal terminal, a first electrode of the eighth transistor is connected to the second voltage signal terminal, and a second electrode of the eighth transistor is connected to the third node. The second control sub-circuit includes a ninth transistor and a tenth transistor; a gate of the ninth transistor is connected to the enable signal terminal, a first electrode of the ninth transistor is connected to the first voltage signal terminal, and a second electrode of the ninth transistor is connected to the fourth node; a gate of the tenth transistor is connected to the enable signal terminal, a first electrode of the tenth transistor is connected to a second electrode of the first transistor, and a second electrode of the tenth transistor is connected to the element to be driven. The potential control sub-circuit includes an eleventh transistor, a twelfth transistor, a thirteenth transistor, a fourteenth transistor, a fifteenth transistor and a sixteenth transistor; a gate of the eleventh transistor is connected to the third node, a first electrode of the eleventh transistor is connected to the second power supply voltage signal terminal, and a second electrode of the eleventh transistor is connected to a first electrode of the twelfth transistor; a gate of the twelfth transistor is connected to the third node, and a second electrode of the twelfth transistor is connected to the second node; a gate of the thirteenth transistor is connected to the third node, a first electrode of the thirteenth transistor is connected to the third power supply voltage signal terminal, and a second electrode of the thirteenth transistor is connected to a first electrode of the fourteenth transistor; a gate of the fourteenth transistor is connected to the third node, and a second electrode of the fourteenth transistor is connected to the second node; a gate of the fifteenth transistor is connected to the second node, a first electrode of the fifteenth transistor is connected to the third power supply voltage signal terminal, and a second electrode of the fifteenth transistor is connected to the second electrode of the eleventh transistor and the first electrode of the twelfth transistor; a gate of the sixteenth transistor is connected to the second node, a first electrode of the sixteenth transistor is connected to the second power supply voltage signal terminal, and a second electrode of the sixteenth transistor is connected to the second electrode of the thirteenth transistor and the first electrode of the fourteenth transistor. The eleventh transistor, the twelfth transistor, and the fifteenth transistor are all P-type transistors, and the thirteenth transistor, the fourteenth transistor, and the sixteenth transistor are all N-type transistors; or the eleventh transistor, the twelfth transistor, and the fifteenth transistor are all N-type transistors, and the thirteenth transistor, the fourteenth transistor, and the sixteenth transistor are all P-type transistors.

In a second aspect, a display panel is provided. The display panel includes a plurality of pixel driving circuits as described above and a plurality of elements to be driven. Each element to be driven is connected to a corresponding pixel driving circuit.

In some embodiments, the display panel has a plurality of sub-pixel regions, and each pixel driving circuit is disposed in a single sub-pixel region. The display panel further includes a plurality of first scan signal lines, a plurality of first data signal lines, a plurality of second scan signal lines, a plurality of second data signal lines, and a plurality of enable signal lines. First scan signal terminals connected to pixel driving circuits in a same row of sub-pixel regions are connected to a corresponding first scan signal line. First data signal terminals connected to pixel driving circuits in a same column of sub-pixel regions are connected to a corresponding first data signal line. Second scan signal terminals connected to the pixel driving circuits in the same row of sub-pixel regions are connected to a corresponding second scan signal line. Second data signal terminals connected to the pixel driving circuits in the same column of sub-pixel regions are connected to a corresponding second data signal line. Enable signal terminals connected to the pixel driving circuits in the same row of sub-pixel regions are connected to a corresponding enable signal line.

In some embodiments, the element to be driven is a current-driven light-emitting device.

In a third aspect, a display device is provided. The display device includes the display panel as described above.

In a fourth aspect, a driving method for the pixel driving circuit as described above is provided. A period of a single frame includes a scanning period and a working period, and the scanning period includes a plurality of row scanning periods. The driving method includes: in each of the plurality of row scanning periods, writing, by the signal control sub-circuit, at least the first data signal from the first data signal terminal into the first node, in response to the first scan signal received from the first scan signal terminal; writing, by the time control sub-circuit, the second data signal from the second data signal terminal into the fourth node, in response to the second scan signal received from the second scan signal terminal; and writing, by the time control sub-circuit, the second voltage signal from the second voltage signal terminal into the third node, in response to the second scan signal received from the second scan signal terminal; and in the working period, enabling, by the signal control sub-circuit, the first driving sub-circuit to output the driving signal to the first transistor according to the first data signal and the first power supply voltage signal provided by the first power supply voltage signal terminal, in response to the enable signal received from the enable signal terminal; writing, by the time control sub-circuit, the first voltage signal that changes within the set voltage range provided by the first voltage signal terminal into the fourth node, in response to the enable signal received from the enable signal terminal, so that the voltage on the third node changes as the voltage difference between the first voltage signal and the second data signal changes; and transmitting, by the time control sub-circuit, the second power supply voltage signal provided by the second power supply voltage signal terminal and the third power supply voltage signal provided by the third power supply voltage signal terminal to the second node in different periods, in response to the change of the voltage on the third node, so as to control the turn-on time of the first transistor and thus control a working time of the element to be driven.

In some embodiments, the signal control sub-circuit further includes a first data writing sub-circuit and a first control sub-circuit. The first driving sub-circuit includes a driving transistor, and a gate of the driving transistor is connected to the first node. The first data writing sub-circuit is connected to the first scan signal terminal, the first data signal terminal, and the driving transistor. The first control sub-circuit is connected to the enable signal terminal, the first power supply voltage signal terminal, the driving transistor, and a first electrode of the first transistor.

In each of the plurality of row scanning periods, writing, by the signal control sub-circuit, at least the first data signal into the first node in response to the received first scan signal, and in the working period, enabling, by the signal control sub-circuit, the first driving sub-circuit to output the driving signal to the first transistor according to the first data signal and the first power supply voltage signal in response to the received enable signal, includes: in each of the plurality of row scanning periods, writing, by the first data writing sub-circuit, the first data signal and a threshold voltage of the driving transistor into the first node, in response to the received first scan signal, so as to perform threshold voltage compensation on the driving transistor; and in the working period, enabling, by the first control sub-circuit, the driving transistor to be connected to the first power supply voltage signal terminal and the first electrode of the first transistor, in response to the received enable signal; and outputting, by the driving transistor, the driving signal to the first electrode of the first transistor according to the first data signal and the first power supply voltage signal.

In some embodiments, the time control sub-circuit further includes a second data writing sub-circuit, a second control sub-circuit, and a potential control sub-circuit. The second driving sub-circuit further includes a second capacitor. A gate of the first transistor is connected to the second node, and a first electrode of the first transistor is connected to the signal control sub-circuit. One terminal of the second capacitor is connected to the third node, and another terminal of the second capacitor is connected to the fourth node. The second data writing sub-circuit is connected to the second scan signal terminal, the second data signal terminal, the second voltage signal terminal, the third node, and the fourth node. The second control sub-circuit is connected to the enable signal terminal, the first voltage signal terminal, a second electrode of the first transistor, the fourth node, and the element to be driven. The potential control sub-circuit is connected to the second node, the third node, the second power supply voltage signal terminal, and the third power supply voltage signal terminal.

In each of the plurality of row scanning periods, writing, by the time control sub-circuit, the second data signal into the fourth node, in response to the received second scan signal; and writing, by the time control sub-circuit, the second voltage signal into the third node, in response to the received second scan signal; and in the working period, writing, by the time control sub-circuit, the first voltage signal into the fourth node, in response to the received enable signal, so that the voltage on the third node changes as the voltage difference between the first voltage signal and the second data signal changes; and transmitting, by the time control sub-circuit, the second power supply voltage signal and the third power supply voltage signal to the second node in different periods, in response to the change of the voltage on the third node, includes: in each of the plurality of row scanning periods, writing, by the second data writing sub-circuit, the second data signal into the fourth node, in response to the received second scan signal; and writing, by the second data writing sub-circuit, the second voltage signal into the third node, in response to the received second scan signal; and in the working period, writing, by the second control sub-circuit, the first voltage signal into the fourth node, in response to the received enable signal, so that the voltage on the third node changes as the voltage difference between the first voltage signal and the second data signal changes; and enabling, by the second control sub-circuit, the second electrode of the first transistor to be connected to the element to be driven, in response to the received enable signal; and transmitting, by the potential control sub-circuit, the second power supply voltage signal and the third power supply voltage signal to the second node in different periods, in response to the change of the voltage on the third node.

BRIEF DESCRIPTION OF THE DRAWINGS

In order to explain technical solutions in some embodiments of the present disclosure more clearly, accompanying drawings to be used in some embodiments of the present disclosure will be briefly introduced below. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method and an actual timing of a signal involved in the embodiments of the present disclosure.

DETAILED DESCRIPTION

Figure 1:
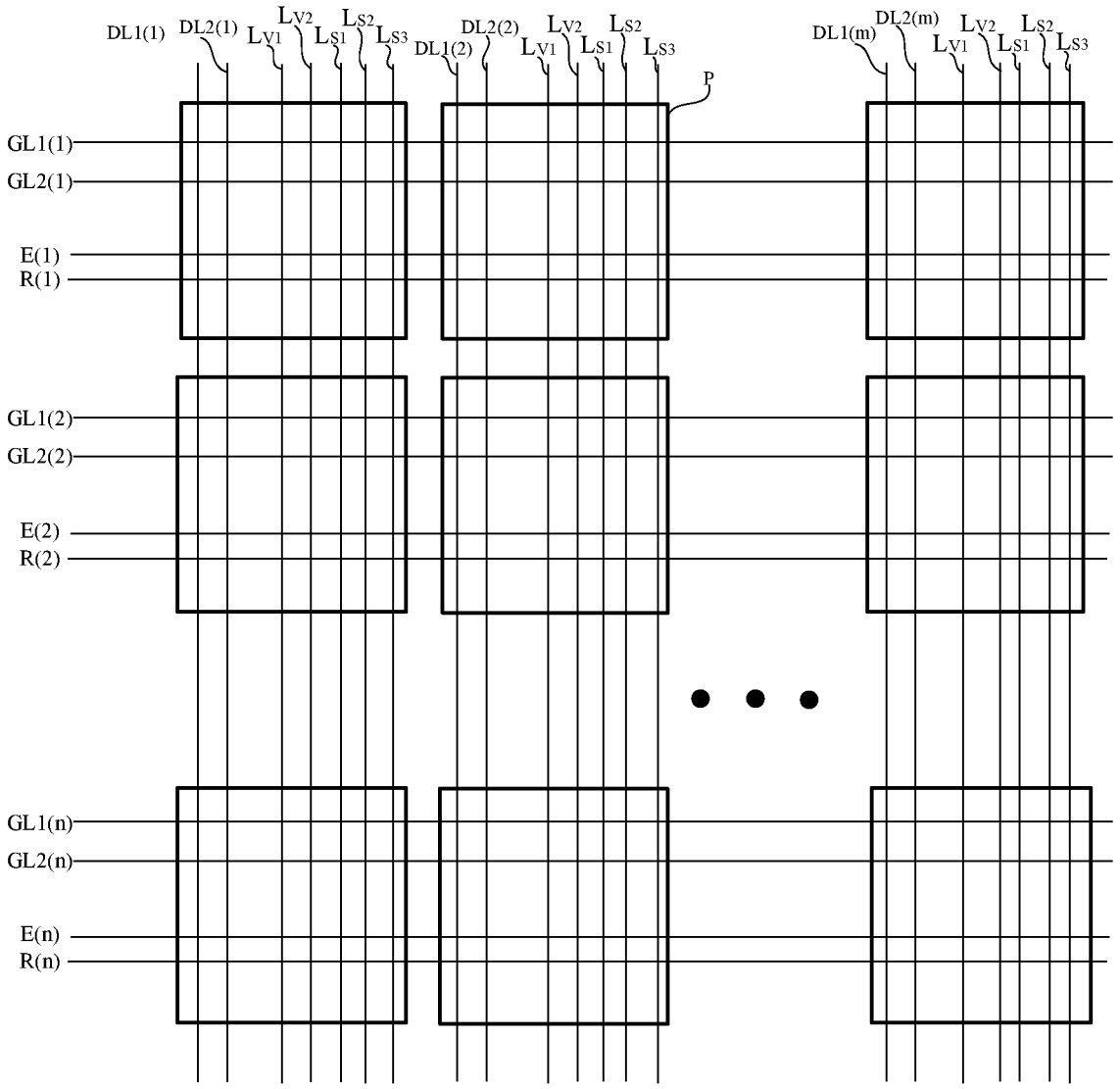
FIG. 1 is a diagram showing a structure of a display panel, in accordance with some embodiments of the present disclosure.

Technical solutions provided in some embodiments of the present disclosure will be described clearly and completely below with reference to accompanying drawings. Obviously, the described embodiments are merely some but not all embodiments of the present disclosure, and all other embodiments obtained based on the embodiments of the present disclosure by a person of ordinary skill in the art shall be included in the protection scope of the present disclosure.

Unless the context requires otherwise, throughout the description and claims, the term "comprise" and other forms thereof such as the third-person singular form "comprises" and the present participle form "comprising" are construed as an open and inclusive meaning, that is, "including, but not limited to". In the description, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, a feature defined with "first" and "second" may explicitly or implicitly include one or more of the features. In the description of the embodiments of the present disclosure, the term "a plurality of/the plurality of" means two or more unless otherwise specified.

In the description of some embodiments, the term "connected" and derivatives thereof may be used. For example, the term "connected" may be used in the description of some embodiments to indicate that two or more components are in direct physical contact or electrical contact with each other. The embodiments disclosed herein are not necessarily limited to the content herein.

As used herein, depending on the context, the term "if" is optionally construed as "when" or "in a case where" or "in response to determining" or "in response to detecting".

The expression such as "configured to" as used herein indicates an open and inclusive expression, which does not exclude devices that are applicable to or configured to perform additional tasks or steps.

In addition, the phrase "based on" as used herein has an open and inclusive meaning, since a process, step, calculation or other action that is "based on" one or more of the conditions may be based on additional conditions in practice.

As used herein, "about" or "approximately" includes a stated value as well as an average value within an acceptable range of deviation of a particular value. The acceptable range of deviation is determined by a person of ordinary skill in the art considering the measurement in question and errors associated with the measurement of a particular quantity (i.e., limitations of the measurement system).

Some embodiments of the present disclosure provide a display device. The display device includes a display panel. As shown in FIG. 1, the display panel has a plurality of sub-pixel regions P.

In some embodiments, as shown in FIG. 1, the plurality of sub-pixel regions P are arranged in an array of a plurality of rows and a plurality of columns, but the embodiments of the present disclosure are not limited thereto.

Figure 2:
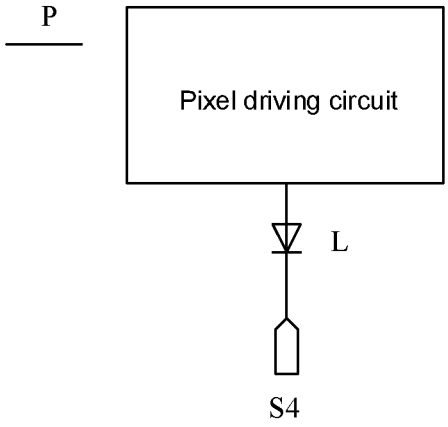
FIG. 2 is a diagram showing a connection between a pixel driving circuit and an element to be driven, in accordance with some embodiments of the present disclosure.

The display panel includes a plurality of pixel driving circuits and a plurality of elements to be driven L. As shown in FIG. 2, each element to be driven L is connected to a corresponding pixel driving circuit. Each pixel driving circuit and the element to be driven L connected thereto are arranged in a sub-pixel region P. The pixel driving circuit is configured to drive the element to be driven L to work.

In some embodiments, a first electrode of the element to be driven L is connected to the pixel driving circuit, and a second electrode of the element to be driven L is connected to a fourth power supply voltage signal terminal S4.

In some examples, the first electrode and the second electrode of the element to be driven L are an anode and a cathode, respectively.

In some embodiments, the element to be driven L is a current-driven light-emitting device, such as a micro light-emitting diode (Micro LED), a mini light-emitting diode (Mini LED), or an organic light-emitting diode (OLED). In this case, the expression that the element to be driven L works may be understood as that a current-driven light-emitting device emits light.

Figure 3:
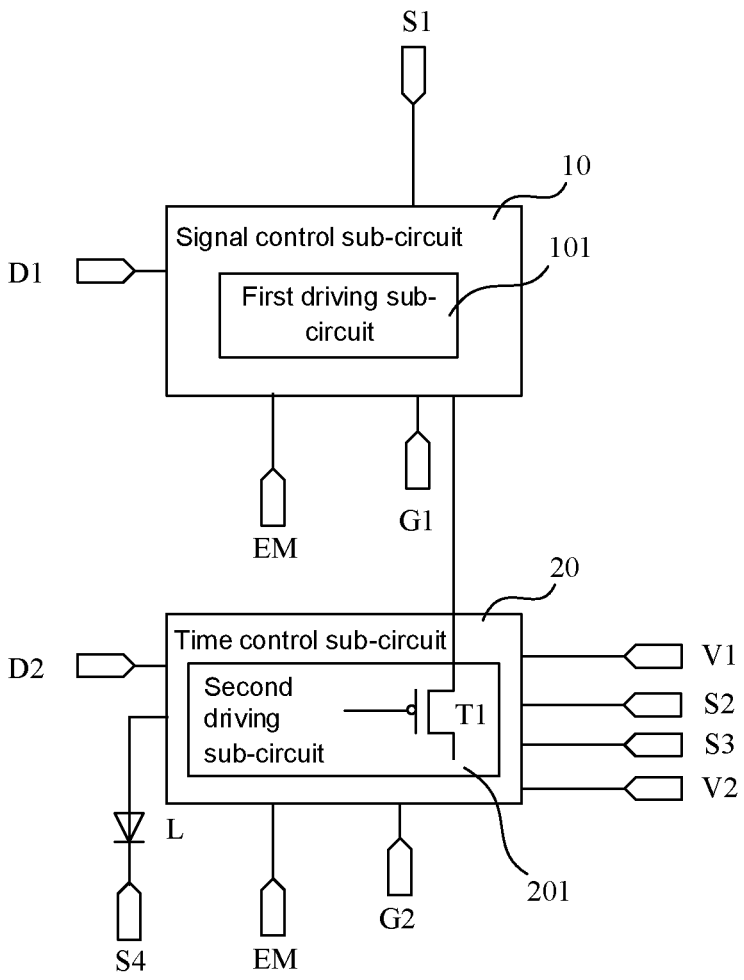
FIG. 3 is a block diagram showing a structure of a pixel driving circuit, in accordance with some embodiments of the present disclosure.

Based on the above, some embodiments of the present disclosure provide a pixel driving circuit. As shown in FIG. 3, the pixel driving circuit includes a signal control sub-circuit 10 and a time control sub-circuit 20. The signal control sub-circuit 10 includes a first driving sub-circuit 101. The time control sub-circuit 20 includes a second driving sub-circuit 201, and the second driving sub-circuit 201 includes a first transistor T1.

Figure 4:
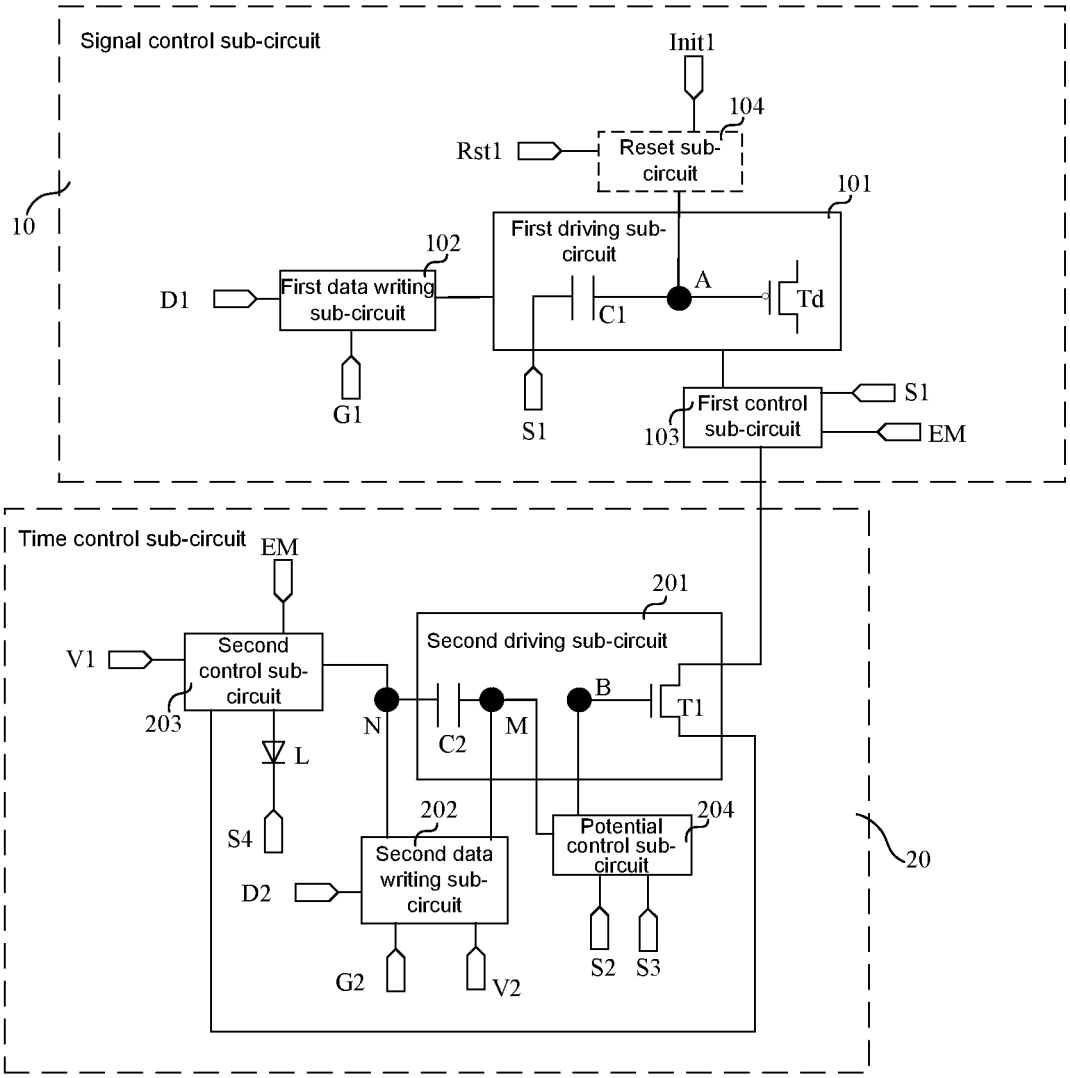
FIG. 4 is a block diagram showing a structure of another pixel driving circuit, in accordance with some embodiments of the present disclosure.

The signal control sub-circuit 10 is connected to a first scan signal terminal G1, a first data signal terminal D1, a first power supply voltage signal terminal S1, and an enable signal terminal EM. The first driving sub-circuit 101 is connected to a first node A (as shown in FIG. 4).

The signal control sub-circuit 10 is configured to: write at least a first data signal provided by the first data signal terminal D1 into the first node A, in response to a first scan signal received from the first scan signal terminal G1, and enable the first driving sub-circuit 101 to output a driving signal according to the first data signal provided by the first data signal terminal D1 and a first power supply voltage signal provided by the first power supply voltage signal terminal S1, in response to an enable signal received from the enable signal terminal EM.

The time control sub-circuit 20 is connected to a second scan signal terminal G2, a second data signal terminal D2, the enable signal terminal EM, a first voltage signal terminal V1, a second voltage signal terminal V2, a second power supply voltage signal terminal S2, a third power supply voltage signal terminal S3, the signal control sub-circuit 10 and an element to be driven L. The second driving sub-circuit 201 is connected to a second node B, a third node M, and a fourth node N (as shown in FIG. 4); a gate of the first transistor T1 is connected to the second node B, and a first electrode of the first transistor T1 is connected to the signal control sub-circuit 10.

The time control sub-circuit 20 is configured to: write a second data signal provided by the second data signal terminal D2 into the fourth node N, and write a second voltage signal provided by the second voltage signal terminal V2 into the third node M, in response to a second scan signal received from the second scan signal terminal G2; write a first voltage signal that changes within a set voltage range provided by the first voltage signal terminal V1 into the fourth node N, in response to the enable signal received from the enable signal terminal EM, so that a voltage on the third node M changes as a voltage difference between the first voltage signal and the second data signal changes; and transmit a second power supply voltage signal provided by the second power supply voltage signal terminal S2 and a third power supply voltage signal provided by the third power supply voltage signal terminal S3 to the second node B in different periods in response to a change of the voltage on the third node M, so as to control a turn-on time of the first transistor T1, and transmit the driving signal output by the signal control sub-circuit 10 to the element to be driven L when the first transistor T1 is turned on. That is, the purpose is to control a working time of the element to be driven L by controlling the turn-on time of the first transistor T1.

Herein, since a voltage of the first voltage signal changes within the set voltage range, when the first voltage signal is written into the fourth node N, a voltage on the fourth node N changes as the voltage of the first voltage signal changes. A voltage difference on the fourth node N is the voltage difference between the first voltage signal and the second data signal. Correspondingly, the voltage on the third node M changes as voltage difference between the first voltage signal and the second data signal changes.

In the pixel driving circuit provided in the embodiments of the present disclosure, the first node A, the second node B, the third node M, and the fourth node N do not represent actual components, but represent junctions of related electrical connections in the circuit diagram. That is to say, these nodes are equivalent to junctions of related electrical connections in the circuit diagram.

In some embodiments, a voltage of the second power supply voltage signal and a voltage of the third power supply voltage signal are both fixed. In some examples, the voltage of the second power supply voltage signal is a high voltage, and the voltage of the third power supply voltage signal is a low voltage. In some other examples, the voltage of the second power supply voltage signal is a low voltage, and the voltage of the third power supply voltage signal is a high voltage.

It will be noted that, the high voltage and low voltage in the embodiments of the present disclosure are relative, a higher voltage of the two is the high voltage, and a lower voltage of the two is the low voltage.

In some embodiments, a voltage of the second voltage signal is fixed.

It can be seen from the above description that, the signal control sub-circuit 10 outputs the driving signal, and the time control sub-circuit 20 controls a duration during which the driving signal is transmitted to the element to be driven L, so as to control the working time of the element to be driven L. Here, in a case where the element to be driven L is a current-driven light-emitting device, the expression that the signal control sub-circuit 10 outputs the driving signal may be understood as that the signal control sub-circuit 10 outputs a driving current. The time control sub-circuit 20 transmits the driving current to the current-driven light-emitting device to cause the current-driven light-emitting device to emit light.

In the signal control sub-circuit 10, a magnitude of the driving signal output by the signal control sub-circuit 10 to the first transistor T1 is controlled by controlling a magnitude of the first data signal provided by the first data signal terminal D1. In the time control sub-circuit 20, the second power supply voltage signal provided by the second power supply voltage signal terminal S2 and the third power supply voltage signal provided by the third power supply voltage signal terminal S3 are transmitted to the second node B in different periods by controlling magnitudes of the first voltage signal provided by the first voltage signal terminal V1, the second voltage signal provided by the second voltage signal terminal V2, and the second data signal provided by the second data signal terminal D2. Therefore, the turn-on time of the first transistor T1 is controlled, so as to control the working time of the element to be driven L. When the first transistor T1 is turned on, the driving signal is transmitted to the element to be driven L through the first transistor T1, and drives the element to be driven L to work.

In this way, when the element to be driven L displays different grayscales, by controlling a magnitude of the driving signal of the element to be driven L and a light-emitting duration of the element to be driven L, it may be possible to change a luminance of the element to be driven L, and thus realize display of a corresponding grayscale. In a case where the element to be driven L is a current-driven light-emitting device, when the element to be driven L displays a relatively high grayscale, the pixel driving circuit outputs a relatively large driving current to the element to be driven L, and may control the light-emitting duration of the element to be driven L to be a maximum light-emitting duration; when the element to be driven L displays a relatively low grayscale, the driving current output by the pixel driving circuit to the element to be driven L may be a relatively large value (e.g., a current corresponding to a high grayscale), and the light-emitting duration of the element to be driven L is shortened (that is, the first transistor T1 is controlled to be turned on later) to lower the luminance of the element to be driven L. Or, when the element to be driven L displays a relatively low grayscale, the driving current output by the pixel driving circuit to the element to be driven L is maintained in a range of a relatively high value (for example, the driving current in the range of the relatively high value is close to a current when high grayscale display is displayed), and the light-emitting duration of the element to be driven L is shortened to lower the luminance of the element to be driven L. Therefore, whether the element to be driven L displays the high grayscale or the low grayscale, the driving current is always large, and the element to be driven L is always at a high current density. As a result, the element to be driven L has higher luminous efficiency, more stable luminance, lower power consumption, and better display effect.

In addition, in the pixel driving circuit provided in some embodiments of the present disclosure, in a case where the voltage of the second power supply voltage signal and the voltage of the third power supply voltage signal are both fixed, by controlling a voltage value of the second power supply voltage signal and a voltage value of the third power supply voltage signal, it may be possible to control the first transistor T1 to be in a completely turned-off state or a completely turned-on state (for example, the second power supply voltage signal causes the first transistor T1 to be in the completely turned-off state, and the third power supply voltage signal causes the first transistor T1 to be in the completely turned-on state). In this way, it may be possible to realize accurate control of the working time of the driving element L, and thus realize corresponding grayscale display. In addition, it may be possible to avoid such problems as decreased uniformity of grayscale display and color cast when the first transistor T1 is not completely turned on or not completely turned off.

In some embodiments, the first data signal provided by the first data signal terminal D1 is a fixed high-level signal that allows the element to be driven L to have a relatively high luminous efficiency. In this case, the pixel driving circuit controls the grayscale by controlling the working time of the element to be driven L through the time control sub-circuit 20. In some other embodiments, the voltage of the first data signal changes within a voltage range, and the first data signal within the voltage range ensures that the element to be driven L has a relatively high luminous efficiency. In this case, the pixel driving circuit controls the grayscale through both the signal control sub-circuit 10 and the time control sub-circuit 20.

Based on the above, as shown in FIG. 1, the display panel further includes: a plurality of first scan signal lines GL1(1)~GL1(*n*), a plurality of first data signal lines DL1(1)~DL1(*m*), a plurality of second scan signal lines GL2(1)~GL2(*n*), a plurality of second data signal lines DL2(1)~DL2(*m*), and a plurality of enable signal lines E(1)~E(n). The first scan signal line is configured to provide the first scan signal to the pixel driving circuit. The second scan signal line is configured to provide the second scan signal to the pixel driving circuit. The enable signal line is configured to provide the enable signal to the pixel driving circuit. The first data signal line is configured to provide the first data signal to the pixel driving circuit. The second data signal line is configured to provide the second data signal to the pixel driving circuit.

In some examples, pixel driving circuits in the same row of sub-pixel regions P are connected to the same first scan signal line in the plurality of first scan signal lines GL1(1)~GL1(*n*), the same second scan signal line in the plurality of second scan signal lines GL2(1)~GL2(*n*), and the same enable signal line in the plurality of enable signal lines E(1)~E(n). Pixel driving circuits in the same column of sub-pixel regions P are connected to the same first data signal line in the plurality of first data signal lines DL1(1)~DL1(*m*), and the same second data signal line in the plurality of second data signal lines DL2(1)~DL2(*m*).

For example, as shown in FIG. 1, pixel driving circuits in a first row of sub-pixel regions P are connected to a first scan signal line G1(1), a second scan signal line G2(1), and an enable signal line E(1). Pixel driving circuits in a second row of sub-pixel regions P are connected to a first scan signal line G1(2), a second scan signal line G2(2), and an enable signal line E(2). Pixel driving circuits in an n-th row of sub-pixel regions P are connected to a first scan signal line GL1(*n*), a second scan signal line GL2(*n*), and an enable signal line E(n). Pixel driving circuits in a first column of sub-pixel regions P are connected to a first data signal line DL1(1) and a second data signal line DL2(1). Pixel driving circuits in a second column of sub-pixel regions P are connected to a first data signal line DL1(2) and a second data signal line DL2(2). Pixel driving circuits in an m-th column of sub-pixel regions P are connected to a first data signal line DL1(*m*) and a second data signal line DL2(*m*). Here, n and m are both positive integers.

The first scan signal terminal G1 may be understood as an equivalent connection point after the first scan signal line is connected to the pixel driving circuit. That is to say, first scan signal terminals G1 connected to the pixel driving circuits in the same row of sub-pixel regions P are connected to a corresponding first scan signal line. The same applies to the second scan signal terminal G2. The first data signal terminal D1 may be understood as an equivalent connection point after the first data signal line is connected to the pixel driving circuit. That is to say, first data signal terminals D1 connected to the pixel driving circuits in the same column of sub-pixel regions P are connected to a corresponding first data signal line. The same applies to the second data signal terminal D2. The enable signal terminal EM may be understood as an equivalent connection point after the enable signal line is connected to the pixel driving circuit. That is to say, enable signal terminals EM connected to the pixel driving circuits in the same row of sub-pixel regions P are connected to a corresponding enable signal line.

As shown in FIG. 1, the display panel further includes a plurality of first power supply voltage signal lines $L_{S1}$. The first power supply voltage signal line $L_{S1}$ is configured to provide the first power supply voltage signal to the pixel driving circuit. In some examples, the pixel driving circuits in the same column of sub-pixel regions P are connected to the same first power supply voltage signal line $L_{S1}$ in the plurality of first power supply voltage signal lines $L_{S1}$. Here, FIG. 1 illustrates an example where pixel driving circuits in any two columns of sub-pixel regions P are connected to different first power supply voltage signal lines $L_{S1}$, but the embodiments of the present disclosure are not limited thereto, and it may be that pixel driving circuits in columns (e.g., four columns) of sub-pixel regions P are connected to the same first power supply voltage signal line $L_{S1}$.

As shown in FIG. 1, the display panel further includes a plurality of first voltage signal lines $L_{V1}$, a plurality of second voltage signal lines $L_{V2}$, a plurality of second power supply voltage signal lines $L_{S2}$, and a plurality of third power supply voltage signal lines $L_{S3}$. The first voltage signal line $L_{V1}$ is configured to provide the first voltage signal to the pixel driving circuit. The second voltage signal line $L_{V2}$ is configured to provide the second voltage signal to the pixel driving circuit. The second power supply voltage signal line $L_{S2}$ is configured to provide the second power supply voltage signal to the pixel driving circuit. The third power supply voltage signal line $L_{S3}$ is configured to provide the third power supply voltage signal to the pixel driving circuit.

In some examples, as shown in FIG. 1, the pixel driving circuit located in the same column of sub-pixel regions P are connected to the same first voltage signal line $L_{V1}$ in the plurality of first voltage signal lines $L_{V1}$, the same second voltage signal line $L_{V2}$ in the plurality of second voltage signal lines $L_{V2}$, the same second power supply voltage signal line $L_{S2}$ in the plurality of second power supply voltage signal lines $L_{S2}$, and the same third power supply voltage signal line $L_{S3}$ in the plurality of third power supply voltage signal lines $L_{S3}$. FIG. 1 illustrates an example where the pixel driving circuits in any two columns of sub-pixel regions P are connected to different first voltage signal lines $L_{V1}$, different second voltage signal lines $L_{V2}$, different second power supply voltage signal lines $L_{S2}$, and different third power supply voltage signal line $L_{S3}$, but the embodiments of the present disclosure are not limited thereto. For example, pixel driving circuits in columns of sub-pixel regions P are connected to the same first voltage signal line $L_{V1}$, pixel driving circuits in columns of sub-pixel regions P are connected to the same second voltage signal line $L_{V2}$, pixel driving circuits in columns of sub-pixel regions P are connected to the same second power supply voltage signal line $L_{S2}$, and pixel driving circuits in columns of sub-pixel regions P are connected to the same third power supply voltage signal line $L_{S3}$.

The first voltage signal terminal V1, the second voltage signal terminal V2, the second power supply voltage signal terminal S2, and the third power supply voltage signal terminal S3 may be understood in a similar way as the first scan signal terminal G1, and details will not be repeated here.

In some embodiments, the display panel further includes a plurality of fourth power supply voltage signal lines. The fourth power supply voltage signal line is configured to provide a fourth power supply voltage signal to the element to be driven L. For example, fourth power supply voltage signal terminals S4 connected to elements to be driven L in the same column of sub-pixel regions P are connected to a corresponding fourth power supply voltage signal line. That is to say, the elements to be driven L in the same column of sub-pixel regions P are connected to the same fourth power supply voltage signal line (which is not shown in FIG. 1) in the plurality of fourth power supply voltage signal lines. Here, the fourth power supply voltage signal terminal S4 may be understood as an equivalent connection point after the fourth power supply voltage signal line is connected to the element to be driven L.

It will be noted that arrangements of the signal lines included in the display panel described above and the wiring diagram of the display panel shown in FIG. 1 are only exemplary, and the embodiments of the present disclosure are not limited thereto.

Based on the above pixel driving circuit, in some embodiments, as shown in FIG. 4, the signal control sub-circuit 10 includes the first driving sub-circuit 101, a first data writing sub-circuit 102, and a first control sub-circuit 103.

The first driving sub-circuit 101 includes a driving transistor Td, and a gate of the driving transistor Td is connected to the first node A.

The first data writing sub-circuit 102 is connected to the first scan signal terminal G1, the first data signal terminal D1, and a first electrode and a second electrode of the driving transistor Td.

The first data writing sub-circuit 102 is configured to write the first data signal provided by the first data signal terminal D1 and a threshold voltage of the driving transistor Td into the first node A in response to the first scan signal received from the first scan signal terminal G1, so as to perform threshold voltage compensation on the driving transistor Td.

The first control sub-circuit 103 is connected to the enable signal terminal EM, the first power supply voltage signal terminal S1, the first electrode and the second electrode of the driving transistor Td, and the first electrode of the first transistor T1.

The first control sub-circuit 103 is configured to enable the first electrode of the driving transistor Td to be connected to the first power supply voltage signal terminal S1, and enable the second electrode of the driving transistor Td to be connected to the first electrode of the first transistor T1, in response to the enable signal received from the enable signal terminal EM.

The first driving sub-circuit 101 is further connected to the first power supply voltage signal terminal S1.

The driving transistor Td is configured to output the driving signal to the first electrode of the first transistor T1 according to the first data signal provided by the first data signal terminal D1 and the first power supply voltage signal provided by the first power supply voltage signal terminal S1.

In the signal control sub-circuit 10 provided in some embodiments of the present disclosure, the driving signal transmitted to the first transistor T1 is determined by the first power supply voltage signal provided by the first power supply voltage signal terminal S1 and the first data signal provided by the first data signal terminal D1. The driving signal is independent of the threshold voltage of the driving transistor Td. In this way, it may be possible to realize the threshold voltage compensation of the driving transistor Td in the first driving sub-circuit 101, and prevent the threshold voltage of the driving transistor Td from affecting the driving signal. As a result, a luminance uniformity of the display panel may be improved when the element to be driven L works.

Figure 5:
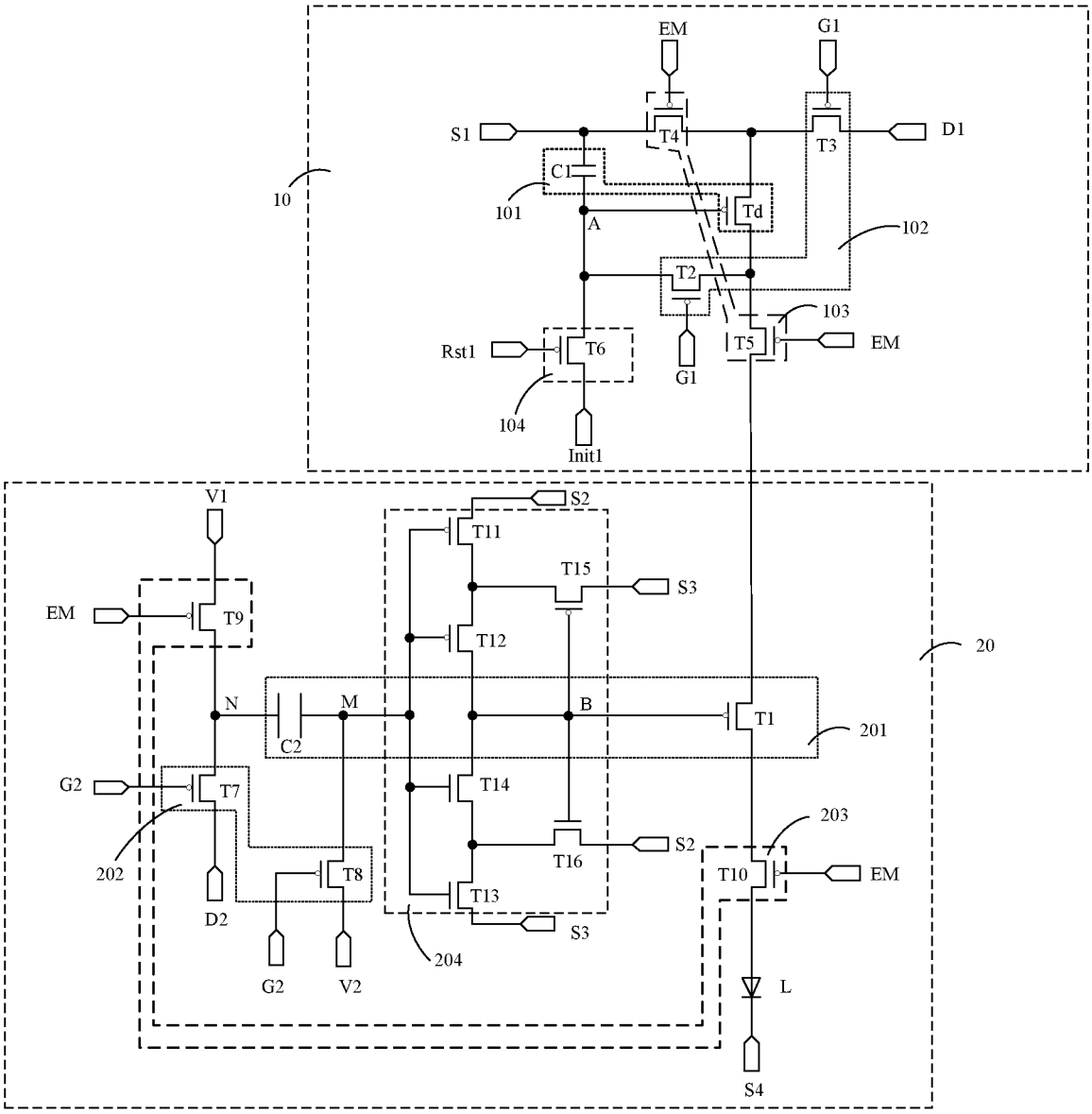
FIG. 5 is a circuit diagram of a pixel driving circuit, in accordance with some embodiments of the present disclosure.

In some examples, as shown in FIG. 5, the first driving sub-circuit 101 includes the driving transistor Td and a first capacitor C1.

One terminal of the first capacitor C1 is connected to the first power supply voltage signal terminal S1, and the other terminal of the first capacitor C1 is connected to the first node A.

In some examples, as shown in FIG. 5, the first data writing sub-circuit 102 includes a second transistor T2 and a third transistor T3.

A gate of the second transistor T2 is connected to the first scan signal terminal G1, a first electrode of the second transistor T2 is connected to the second electrode of the driving transistor Td, and a second electrode of the second transistor T2 is connected to the first node A.

A gate of the third transistor T3 is connected to the first scan signal terminal G1, a first electrode of the third transistor is connected to the first data signal terminal D1, and a second electrode of the third transistor T3 is connected to the first electrode of the driving transistor Td.

In some examples, as shown in FIG. 5, the first control sub-circuit 103 includes a fourth transistor T4 and a fifth transistor T5.

A gate of the fourth transistor T4 is connected to the enable signal terminal EM, a first electrode of the fourth transistor T4 is connected to the first power supply voltage signal terminal S1, and a second electrode of the fourth transistor T4 is connected to the first electrode of the driving transistor Td.

A gate of the fifth transistor T5 is connected to the enable signal terminal EM, a first electrode of the fifth transistor T5 is connected to the second electrode of the driving transistor Td, and a second electrode of the fifth transistor T5 is connected to the first electrode of the first transistor T1.

In some embodiments, as shown in FIG. 4, the signal control sub-circuit 10 further includes a reset sub-circuit 104.

The reset sub-circuit 104 is connected to an initial signal terminal Init1, a reset signal terminal Rst1 and the first node A.

The reset sub-circuit 104 is configured to transmit an initial signal provided by the initial signal terminal Init1 to the first node A in response to a reset signal received from the reset signal terminal Rst1, so as to reset a voltage of the first node A to a voltage of the initial signal.

On this basis, in some embodiments, as shown in FIG. 1, the display panel further includes a plurality of reset signal lines R(1)~R(n) and a plurality of initial signal lines (which are not shown in FIG. 1). The reset signal line is configured to provide the reset signal to the pixel driving circuit. The initial signal line is configured to provide the initial signal to the pixel driving circuit.

In some examples, as shown in FIG. 1, the pixel driving circuits in the same row of sub-pixel regions P are connected to the same reset signal line in the plurality of reset signal lines R(1)~R(n). The pixel driving circuits in the same column of sub-pixel regions P are connected to the same initial signal line in the plurality of initial signal lines.

The reset signal terminal Rst1 may be understood as an equivalent connection point after the reset signal line is connected to the pixel driving circuit. The initial signal terminal Init1 may be understood as an equivalent connection point after the initial signal line is connected to the pixel driving circuit.

Since the other terminal of the first capacitor C1 and the gate of the driving transistor Td are both connected to the first node A, when the reset sub-circuit 104 works, a voltage of the other terminal of the first capacitor C1 and a voltage of the gate of the driving transistor Td are both reset to the voltage of the initial signal, thereby realizing noise reduction of the first driving sub-circuit 101.

In some examples, as shown in FIG. 5, the reset sub-circuit 104 includes a sixth transistor T6.

A gate of the sixth transistor T6 is connected to the reset signal terminal Rst1, a first electrode of the sixth transistor T6 is connected to the initial signal terminal Init1, and a second electrode of the sixth transistor T6 is connected to the first node A.

In some embodiments, as shown in FIG. 4, the time control sub-circuit 20 includes a second data writing sub-circuit 202, the second driving sub-circuit 201, a second control sub-circuit 203 and a potential control sub-circuit 204.

The second driving sub-circuit 201 includes the first transistor T1 and a second capacitor C2. The gate of the first transistor T1 is connected to the second node B, and the first electrode of the first transistor T1 is connected to the signal control sub-circuit 10. One terminal of the second capacitor C2 is connected to the third node M, and the other terminal of the second capacitor C2 is connected to the fourth node N.

The second data writing sub-circuit 202 is connected to the second scan signal terminal G2, the second data signal terminal D2, the second voltage signal terminal V2, the third node M, and the fourth node N.

The second data writing sub-circuit 202 is configured to write the second data signal provided by the second data signal terminal D2 into the fourth node N, and write the second voltage signal provided by the second voltage signal terminal V2 into the third node M, in response to the second scan signal received from the second scan signal terminal G2.

The second control sub-circuit 203 is connected to the enable signal terminal EM, the first voltage signal terminal V1, a second electrode of the first transistor T1, the fourth node N, and the element to be driven L.

The second control sub-circuit 203 is configured to write the first voltage signal provided by the first voltage signal terminal V1 into the fourth node N, and enable the second electrode of the first transistor T1 to be connected to the element to be driven L, in response to the enable signal received from the enable signal terminal EM.

The potential control sub-circuit 204 is connected to the second node B, the third node M, the second power supply voltage signal terminal S2, and the third power supply voltage signal terminal S3.

The potential control sub-circuit 204 is configured to transmit the second power supply voltage signal provided by the second power supply voltage signal terminal S2 and the third power supply voltage signal provided by the third power supply voltage signal terminal S3 to the second node B in different periods, in response to the change of the voltage on the third node M.

In the time control sub-circuit 20 provided in some embodiments of the present disclosure, the second data writing sub-circuit 202 writes the second data signal provided by the second data signal terminal D2 into the fourth node N, so that a voltage of the fourth node N and a voltage of the other terminal of the second capacitor C2 both become a voltage of the second data signal (denoted as $V_{data2}$). In addition, the second voltage signal provided by the second voltage signal terminal V2 is transmitted to the third node M, so that a voltage of the third node M and a voltage of the one terminal of the second capacitor C2 both become the voltage of the second voltage signal (denoted as $V_{V2}$).

On this basis, the second control sub-circuit 203 writes the first voltage signal provided by the first voltage signal terminal V1 into the fourth node N, so that the voltage of the fourth node N changes from the voltage of the second data signal to a voltage of the first data signal (denoted as $V_{V1}$). According to the law of charge conservation of the capacitor, a voltage difference across the second capacitor C2 remains unchanged. Therefore, when the voltage of the fourth node N changes from $V_{data2}$ to $V_{V1}$, the voltage of the third node M will change as the voltage difference between the first voltage signal and the second data signal changes. That is, the voltage of the third node M becomes $(V_{V2}+(V_{V1}-V_{data2}))$.

Since the voltage of the first voltage signal changes within the set voltage range, when the voltage of the first voltage signal is within a certain range, the potential control sub-circuit 204 may transmit one of the second power supply voltage signal and the third power supply voltage signal to the second node B. When the voltage of the first voltage signal reaches a certain value (that is, when the voltage of the third node M changes from $V_{V2}$ to a certain value), the potential control sub-circuit 204 may transmit the other of the second power supply voltage signal and the third power supply voltage signal to the second node B. Since whether the first transistor T1 is turned on or not determines whether the driving signal is transmitted to the element to be driven L, by using the second power supply voltage signal and the third power supply voltage signal to control whether the first transistor T1 is turned on or not, it may be possible to control the working time of the element to be driven L.

In summary, when the element to be driven L performs grayscale display, the voltage of the first voltage signal may be changed to control the times during which the second power supply voltage signal and the third power supply voltage signal are transmitted to the gate of the first transistor T1, so as to control the working time of the element to be driven L and thus control the grayscale.

In some examples, as shown in FIG. 5, the second data writing sub-circuit 202 includes a seventh transistor T7 and an eighth transistor T8.

A gate of the seventh transistor T7 is connected to the second scan signal terminal G2, a first electrode of the seventh transistor T7 is connected to the second data signal terminal D2, and a second electrode of the seventh transistor T7 is connected to the fourth node N.

A gate of the eighth transistor T8 is connected to the second scan signal terminal G2, a first electrode of the eighth transistor T8 is connected to the second voltage signal terminal V2, and a second electrode of the eighth transistor T8 is connected to the third node M.

In some examples, as shown in FIG. 5, the second control sub-circuit 203 includes a ninth transistor T9 and a tenth transistor T10.

A gate of the ninth transistor T9 is connected to the enable signal terminal EM, a first electrode of the ninth transistor T9 is connected to the first voltage signal terminal V1, and a second electrode of the ninth transistor T9 is connected to the fourth node N.

A gate of the tenth transistor T10 is connected to the enable signal terminal EM, a first electrode of the tenth transistor T10 is connected to the second electrode of the first transistor T1, and a second electrode of the tenth transistor T10 is connected to the element to be driven L.

In some examples, as shown in FIG. 5, the potential control sub-circuit 204 includes an eleventh transistor T11, a twelfth transistor T12, a thirteenth transistor T13, a fourteenth transistor T14, a fifteenth transistor T15, and a sixteenth transistor T16.

A gate of the eleventh transistor T11 is connected to the third node M, a first electrode of the eleventh transistor T11 is connected to the second power supply voltage signal terminal S2, and a second electrode of the eleventh transistor T11 is connected to a first electrode of the twelfth transistor T12.

Agate of the twelfth transistor T12 is connected to the third node M, and a second electrode of the twelfth transistor T12 is connected to the second node B.

A gate of the thirteenth transistor T13 is connected to the third node M, a first electrode of the thirteenth transistor T13 is connected to the third power supply voltage signal terminal S3, and a second electrode of the thirteenth transistor T13 is connected to a first electrode of the fourteenth transistor T14.

A gate of the fourteenth transistor T14 is connected to the third node M, and a second electrode of the fourteenth transistor T14 is connected to the second node B.

A gate of the fifteenth transistor T15 is connected to the second node B, a first electrode of the fifteenth transistor T15 is connected to the third power supply voltage signal terminal S3, and a second electrode of the fifteenth transistor T15 is connected to the second electrode of the eleventh transistor T11 and the first electrode of the twelfth transistor T12.

A gate of the sixteenth transistor T16 is connected to the second node B, a first electrode of the sixteenth transistor T16 is connected to the second power supply voltage signal terminal S2, and a second electrode of the sixteenth transistor T16 is connected to the second electrode of the thirteenth transistor T12 and the first electrode of the fourteenth transistor T14.

In some examples, as shown in FIG. 5, the eleventh transistor T11, the twelfth transistor T12, and the fifteenth transistor T15 are all P-type transistors, and the thirteenth transistor T13, the fourteenth transistor T14, and the sixteenth transistor T16 are all N-type transistors. In this case, for example, the first transistor T1 is a P-type transistor, the voltage of the second power supply voltage signal is a fixed high voltage, and the voltage of the third power supply voltage signal is a fixed low voltage.

Figure 6:
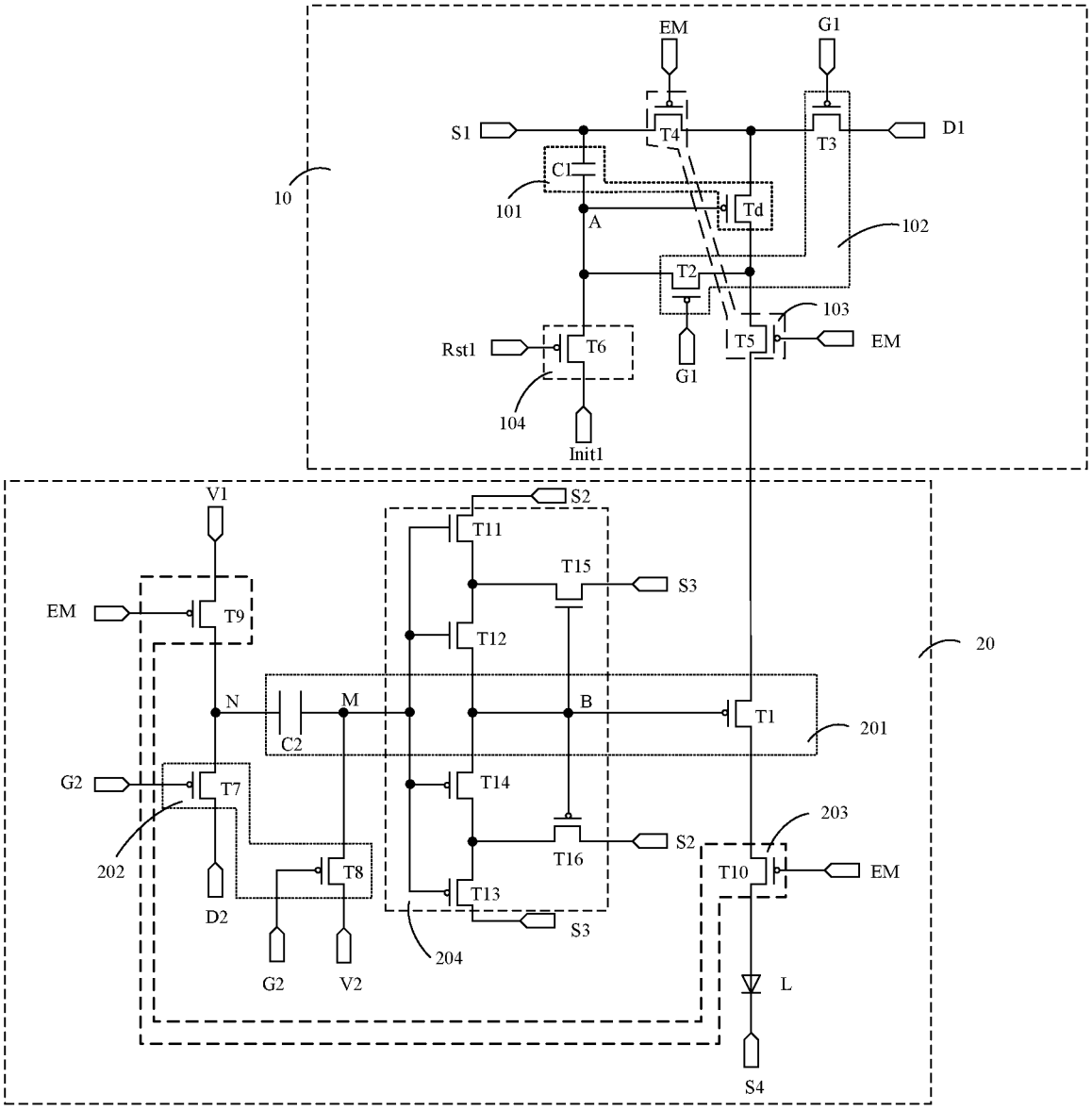
FIG. 6 is a circuit diagram of another pixel driving circuit, in accordance with some embodiments of the present disclosure.

In some other examples, as shown in FIG. 6, the eleventh transistor T11, the twelfth transistor T12, and the fifteenth transistor T15 are all N-type transistors, and the thirteenth transistor T13, the fourteenth transistor T14, and the sixteenth transistor T16 are all P-type transistors. In this case, for example, the first transistor T1 is a P-type transistor, the voltage of the second power supply voltage signal is a fixed low voltage, and the voltage of the third power supply voltage signal is a fixed high voltage.

It will be noted that, except for the transistors in the potential control sub-circuit 204, the embodiments of the present disclosure do not limit the types of other transistors in the pixel driving circuit.

The first electrode of the transistor may be a drain, and the second electrode of the transistor may be a source. Or, the first electrode of the transistor may be a source, and the second electrode of the transistor may be a drain. The embodiments of the present disclosure do not limit this. For example, the driving transistor Td is a P-type transistor, the first electrode of the driving transistor Td is a source, and the second electrode of the driving transistor Td is a drain. For another example, the driving transistor is an N-type transistor, the first electrode of the driving transistor Td is a drain, and the second electrode of the driving transistor Td is a source.

Hereinafter, a driving process of the pixel driving circuit shown in FIG. 5 is described by taking an example where the thirteenth transistor T13, the fourteenth transistor T14, and the sixteenth transistor T16 are all N-type transistors, and other transistors are all P-type transistors, in conjunction with a timing diagram shown in FIG. 7.

Figure 7:
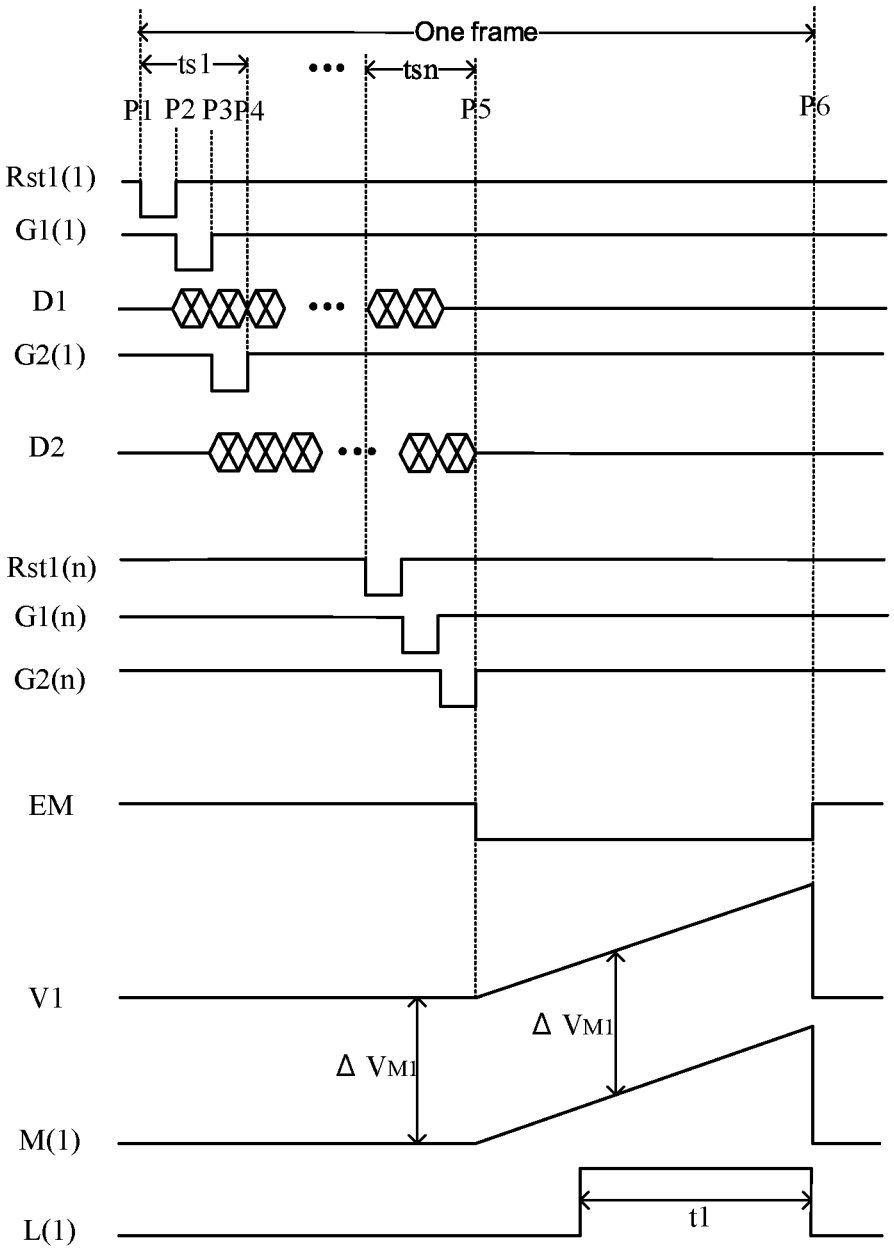
FIG. 7 is a timing diagram of a pixel driving circuit, in accordance with some embodiments of the present disclosure.

As shown in FIG. 7, a period of a single frame includes a scanning period (P1~P5) and a working period (P5~P6), and the scanning period (P1~P5) includes a plurality of row scanning periods. In a case where the plurality of pixel driving circuits in the display panel are arranged in sub-pixel regions of n rows and m columns, the plurality of row scanning periods includes n row scanning periods, and the pixel driving circuits in each row of sub-pixel regions correspond to a single row scanning period. The n row scanning periods are ts1~tsn; the first row scanning period is ts1, and the n-th row scanning period is tsn, n being a positive integer greater than 1.

In the scanning period (P1~P5), the pixel driving circuits in all rows of sub-pixel regions are scanned row by row. That is, the pixel driving circuits are scanned row by row starting from the pixel driving circuits in a first row of sub-pixel regions, and the first data signals and the second data signals are sequentially input to the pixel driving circuits in all rows of sub-pixel regions, until the first data signal and the second data signal are input to the pixel driving circuits in the n-th row of sub-pixel regions.

In some embodiments, after the pixel driving circuits in all rows of sub-pixel regions are scanned row by row, the working period (P5~P6) is performed. In some examples, the pixel driving circuits in all rows of sub-pixel regions may enter the working period in sequence. That is, the pixel driving circuits in the first row of sub-pixel regions enter the working period first, and then the pixel driving circuits in a second row of sub-pixel regions enter the working period, until the pixel driving circuits in the n-th row of sub-pixel regions enter the working period. An effective duration of the enable signal input to the pixel driving circuits in each row of sub-pixel regions is the same in the working period. In some other examples, the pixel driving circuits in all rows of sub-pixel regions enter the working period synchronously.

In some other embodiments, the pixel driving circuits in each row of sub-pixel regions enter the working period after the corresponding row scanning period ends.

In each row scanning period, the same or different first data signals are written into m pixel driving circuits in the same row of m sub-pixel regions synchronously. That is, the first data signals are a group of signals. The same or different second data signals are written into the m pixel driving circuits in the same row of m sub-pixel regions synchronously. That is, the second data signals are a group of signals.

As shown in FIG. 7, in the first row scanning period ts1, each pixel driving circuit in the first row of sub-pixel regions includes a following driving process.

In a first period (P1~P2), in response to the reset signal received from the reset signal terminal Rst1, the sixth transistor T6 is turned on, and transmits the initial signal provided by the initial signal terminal Init1 to the first node A, so as to reset the voltage of the first node A to the voltage of the initial signal (denoted as $V_{init1}$). Since the other terminal of the first capacitor C1 and the gate of the driving transistor Td are both connected to the first node A, the voltage of the other terminal of the first capacitor C1 and the gate voltage of the driving transistor Td are both reset to $V_{init1}$.

The initial signal provided by the initial signal terminal Init1 may eliminate an influence of a signal of a previous frame on the first node A. The initial signal may be a low-level signal or a high-level signal. In a case where the driving transistor Td is a P-type transistor, the initial signal is a signal with a voltage not less than zero.

In the first period (P1~P2), the first scan signal terminal G1, the second scan signal terminal G2, and the enable signal terminal EM are all input with high-level signals, so that the second transistor T2, the third transistor T3, the fourth transistor T4, and the fifth transistor T5 in the signal control sub-circuit 10, and transistors in the time control sub-circuit 20 are all turned off. Therefore, in the first period (P1~P2), the element to be driven L does not work.

In a second period (P2~P3), in response to the first scan signal received from the first scan signal terminal G1, the third transistor T3 is turned on, and transmits the first data signal provided by the first data signal terminal D1 to the first electrode of the driving transistor Td, so that the voltage of the first electrode of the driving transistor Td becomes the voltage of the first data signal (denoted as $V_{data1}$).

In response to the first scan signal received from the first scan signal terminal G1, the second transistor T2 is turned on, and the gate of the driving transistor Td is connected to the second electrode thereof, so that the driving transistor Td is in a saturated state. In this case, the gate voltage of the driving transistor Td is a sum of the voltage of the first electrode thereof and the threshold voltage thereof (denoted as $V_{thd}$). That is, the gate voltage of the driving transistor Td is ($V_{data1}+V_{thd}$). Since the other terminal of the first capacitor C1 and the gate of the driving transistor Td are both connected to the first node A, the voltage of the other terminal of the first capacitor C1 is also ($V_{data1}+V_{thd}$).

On this basis, since the one terminal of the first capacitor C1 is connected to the first power supply voltage signal terminal S1, the voltage of the one terminal of the first capacitor C1 is the voltage of the first power supply voltage signal (denoted as $V_{S1}$). Therefore, there is a voltage difference ($V_{S1}-(V_{data1}+V_{thd})$) across the first capacitor C1, and the first capacitor C1 is charged.

In the second period (P2~P3), the enable signal terminal EM is input with a high-level signal, so that the fourth transistor T4 and the fifth transistor T5 are both turned off. Therefore, the first transistor T1 in the time control sub-circuit 20 is disconnected from the driving transistor Td, and the element to be driven L does not work.

In addition, the reset signal terminal Rst1 is input with a high-level signal, so that the sixth transistor T6 in the signal control sub-circuit 10 is turned off. In the second period (P2~P3), the second scan signal terminal G2 is input with a high-level signal, and the transistors in the time control sub-circuit 20 are all turned off.

In the third period (P3~P4), in response to the second scan signal received from the second scan signal terminal G2, the seventh transistor T7 is turned on, and transmits the second data signal provided by the second data signal terminal D2 to the fourth nodes N, so that the voltage of the fourth node N becomes the voltage $V_{data2}$ of the second data signal. Since the other terminal of the second capacitor C2 is connected to the fourth node N, the voltage of the other terminal of the second capacitor C2 is also $V_{data2}$.

In response to the second scan signal received from the second scan signal terminal G2, the eighth transistor T8 is turned on, and transmits the second voltage signal provided by the second voltage signal terminal V2 to the third node M, so that the voltage of the third node M becomes the voltage $V_{V2}$ of the second voltage signal.

Since the one terminal of the second capacitor C2 is connected to the third node M, the voltage of the one terminal of the second capacitor C2 is also $V_{V2}$. Therefore, there is a voltage difference ($V_{V2}-V_{data2}$) across the second capacitor C2, and the second capacitor C2 is charged.

The second voltage signal provided by the second voltage signal terminal V2 may reset the third node M to eliminate an influence of the signal of the previous frame on the third node M. The second voltage signal may be a fixed high-level signal or a fixed low-level signal.

In the third period (P3~P4), the enable signal terminal EM, the first scan signal terminal G1, and the first reset signal terminal Rst1 are all input with high-level signals, so that the second transistor T2, the third transistor T3, the fourth transistor T4, the fifth transistor T5, the sixth transistor T6, the ninth transistor T9, and the tenth transistor T10 are all turned off. Therefore, the first transistor T1 is disconnected from both the driving transistor Td and the element to be driven L, and the element to be driven L does not work.

It will be noted that, without considering a possible signal interference between the signals, the operations in the second period (P2~P3) and the third period (P3~P4) may be performed simultaneously.

After the first row scanning period ts1 finishes, in the second row scanning period ts2, the pixel driving circuits in the second row of sub-pixel regions are scanned, until in the nth row scanning period tsn, the pixel driving circuits in the n-th row of sub-pixel regions are scanned. As shown in FIG. 7, starting from an end time (P4) of the first row scanning period ts1, during a time period of P4~P5, the pixel driving circuits in the sub-pixel regions from the second row to the n-th row are scanned row by row.

It will be noted that, a driving process of the pixel driving circuits in the sub-pixel regions from the second row to the n-th row in the corresponding row scanning period is the same as the driving process of the pixel driving circuits in the first row of sub-pixel regions in the first row scanning period ts1, and details will not be repeated here. That is to say, in the entire scanning period (P1~P5), the driving process from the first period to the third period as described above needs to be executed n times.

In summary, in the entire scanning period (P1~P5), each of the n row scanning periods includes the first period to the third period. Therefore, the first data signals and the second data signals may be written into the pixel driving circuits in the n rows of sub-s pixel regions, and the first data signals and the second data signals may be stored to prepare for the working period (P5~P6).

In some embodiments, after the pixel driving circuits in the n rows of sub-pixel regions are scanned row by row, the pixel driving circuits in all rows of sub-pixel regions will enter the working period (P5~P6). In the working period (P5~P6), each pixel driving circuit in the first row of sub-pixel regions includes a following driving process.

In the signal control sub-circuit 10, in response to the enable signal received from the enable signal terminal EM, the fourth transistor T4 is turned on, and transmits the first power supply voltage signal provided by the first power supply voltage signal terminal S1 to the first electrode of the driving transistor Td, so that the voltage of the first electrode of the driving transistor Td becomes the voltage $V_{S1}$ of the first power supply voltage signal. That is, the source voltage of the driving transistor Td is $V_{S1}$. In response to the enable signal received from the enable signal terminal EM, the fifth transistor T5 is turned on, so that the second electrode of the driving transistor Td is connected to the first electrode of the first transistor T1 in the time control sub-circuit 20.

According to the law of charge conservation of the capacitor, the voltage difference across the first capacitor C1 remains unchanged. Therefore, in a case where the voltage of the one terminal of the first capacitor C1 is maintained at the voltage $V_{S1}$ of the first power supply voltage signal, the voltage of the other terminal of the first capacitor C1 is still $(V_{data1}+V_{thd})$. That is, the gate voltage of the driving transistor Td is $(V_{data1}+V_{thd})$.

In this way, the gate-source voltage difference of the driving transistor Td is: $V_{gs}=V_{data1}+V_{thd}-V_{S1}$. In this case, the driving transistor Td is turned on when the gate-source voltage difference is less than the threshold voltage thereof. That is, when $(V_{data1}+V_{thd}-V_{S1})<V_{thd}$, the driving transistor Td is turned on and outputs the driving current. The driving current is output from the second electrode of the driving transistor Td, and is transmitted to the first electrode of the first transistor T1 through the fifth transistor T5. In this way, the driving current output from the driving transistor Td is: $I=K\times(V_{gs}-V_{thd})^2=K\times(V_{data1}+V_{thd}-V_{S1}-V_{thd})^2=K\times(V_{data1}-V_{S1})^2$. Here, $K=\frac{1}{2}\times W/L\times C\times u$, W/L is a width-to-length ratio of the driving transistor Td, C is a capacitance of a channel insulating layer, and u is a channel carrier mobility.

It can be seen that the parameter K is determined by a structure of the driving transistor Td. Therefore, the driving current I is determined by the voltage $V_{data1}$ of the first data signal provided by the first data signal terminal D1 and the voltage $V_{S1}$ of the first power supply voltage signal provided by the first power supply voltage signal terminal S1. That is, the driving current I is independent of the threshold voltage of the driving transistor Td. In this way, it may be possible to realize the threshold voltage compensation of the driving transistor Td, and prevent the threshold voltage of the driving transistor Td from affecting the luminance of the element to be driven L. This may help improve the luminance uniformity of the element to be driven L.

On this basis, when elements to be driven L in sub-pixel regions display different grayscales, since the same first power supply voltage signal may be input to the pixel driving circuits in the sub-pixel regions, and the first power supply voltage signal may be set to a fixed level signal, by controlling the first data signal, it may be possible to control a magnitude of the driving current I, and thus control the grayscale.

In the time control sub-circuit 20, in response to the enable signal received from the enable signal terminal EM, the ninth transistor T9 is turned on, and transmits the first voltage signal provided by the first voltage signal terminal V1 to the fourth node N, so that the voltage of the fourth node N changes from the voltage $V_{data2}$ of the second data signal to the voltage $V_{V1}$ of the first voltage signal. In this way, the voltage of the other terminal of the second capacitor C2 also changes from $V_{data2}$ to $V_{V1}$.

According to the law of charge conservation of the capacitor, the voltage difference across the second capacitor C2 remains unchanged. Before the first voltage signal is transmitted to the fourth node N, as described above, the voltage difference across the second capacitor C2 is $(V_{V2}-V_{data2})$. Therefore, when the voltage of the other terminal of the second capacitor C2 changes from $V_{data2}$ to $V_{V1}$, the voltage of the one terminal of the second capacitor C2 is $(V_{V2}-V_{data2}+V_{V1})$.

In this case, the voltage of the third node M connected to the one terminal of the second capacitor C2 changes from $V_{V2}$ to $(V_{V2}-V_{data2}+V_{V1})$. Since the voltage $V_{V1}$ of the first voltage signal changes within the set voltage range, the voltage of the third node M will change as $V_{V1}$ changes, and the voltage of the third node M changes at the same speed as the voltage of the first voltage signal.

As shown in FIG. 5, the eleventh transistor T11, the twelfth transistor T12, and the fifteenth transistor T15 are all P-type transistors, and the thirteenth transistor T13, the fourteenth transistor T14, and the sixteenth transistor T16 are all N-type transistors. In this case, the voltage of the second power supply voltage signal provided by the second power supply voltage signal terminal S2 is a high voltage, and the voltage of the third power supply voltage signal provided by the third power supply voltage signal terminal S3 is a low voltage.

On this basis, as shown in FIG. 7, when the voltage $(V_{V2}-V_{data2}+V_{V1})$ of the third node M is a low voltage, the eleventh transistor T11 and the twelfth transistor T12 are turned on. The second power supply voltage signal provided by the second power supply voltage signal terminal S2 is transmitted to the first electrode of the twelfth transistor T12 through the eleventh transistor T11, and is then transmitted to the second node B through the second electrode of the twelfth transistor T12, so that the voltage of the second node B becomes the voltage $V_{S2}$ of the second power supply voltage signal. Since the voltage of the second power supply voltage signal is the high voltage, the sixteenth transistor T16 is turned on, and transmits the second power supply voltage signal provided by the second power supply voltage signal terminal S2 to the second electrode of the thirteenth transistor T13 and the first electrode of the fourteenth transistor T14, so that a voltage of the second electrode of the thirteenth transistor T13 and a voltage of the first electrode of the fourteenth transistor T14 are both the voltage $V_{S2}$ of the second power supply voltage signal.

Since the second electrode of the fourteenth transistor T14 is connected to the second node B, a voltage of the second electrode of the fourteenth transistor T14 is the voltage $V_{S2}$ of the second power supply voltage signal. That is, the voltage of the first electrode of the fourteenth transistor T14 and the voltage of the second electrode of the fourteenth transistor T14 are both the voltage of the second power supply voltage signal $V_{S2}$. In this case, a voltage drop of the fourteenth transistor T14 is zero. In addition, the voltage drops of the eleventh transistor T11 and the twelfth transistor T12 are also zero.

A voltage of the first electrode of the thirteenth transistor T13 is the voltage $V_{S3}$ of the third power supply voltage signal provided by the third power supply voltage signal terminal S3, and the voltage of the second electrode of the thirteenth transistor T13 is the voltage $V_{S2}$ of the second power supply voltage signal, which makes the thirteenth transistor T13 bear a relatively large voltage drop. Therefore, the third power supply voltage signal will not be transmitted to the second node B through the thirteenth transistor T13 and the fourteenth transistor T14.

In this way, when the eleventh transistor T11 and the twelfth transistor T12 are both in the turned-on state, even if the fourteenth transistor T14 and the thirteenth transistor T13 are in a transition state of neither completely turned off nor completely turned on, the third power supply voltage signal from the third power supply voltage signal terminal S3 will not be transmitted to the second node B through the thirteenth transistor T13 and the fourteenth transistor T14. That is, the third power supply voltage signal will not affect the second node B. As a result, the voltage of the second node B may be maintained at exactly the voltage of the second power supply voltage signal, and the gate voltage of the first transistor T1 may be controlled at exactly the voltage $V_{S2}$ of the second power supply voltage signal.

When the voltage of the third node M is the low voltage, due to action of the potential control sub-circuit 204, the voltage of the second node B is the high voltage. The P-type first transistor T1 is in the turned-off state under control of the high voltage of the second power supply voltage signal, and the element to be driven L does not work.

As shown in FIG. 7, when the voltage of the third node M rises to a high voltage as the voltage of the first voltage signal rises, the thirteenth transistor T13 and the fourteenth transistor T14 are turned on. The third power supply voltage signal from the third power supply voltage signal terminal S3 is transmitted to the first electrode of the fourteenth transistor T14 through the thirteenth transistor T13, and is then transmitted to the second node B through the second electrode of the fourteenth transistor T14, so that the voltage of the second node B becomes the voltage $V_{S3}$ of the third power supply voltage signal.

Since the third power supply voltage signal is a low-level signal, the fifteenth transistor T15 is turned on, and transmits the third power supply voltage signal provided by the third power supply voltage signal terminal S3 to the second electrode of the eleventh transistor T11 and the first electrode of the twelfth transistors T12, so that a voltage of the second electrode of the eleventh transistor T11 and a voltage of the first electrode of the twelfth transistor T12 are both the voltage $V_{S3}$ of the third power supply voltage signal.

Since the second electrode of the twelfth transistor T12 is connected to the second node B, a voltage of the second electrode of the twelfth transistor T12 is the voltage $V_{S3}$ of the third power supply voltage signal. That is, the voltage of the first electrode of the twelfth transistor T12 and the voltage of the second electrode of the twelfth transistor T12 are both the voltage $V_{S3}$ of the third power supply voltage signal. In this case, the voltage drop of the twelfth transistor T12 is zero. In addition, the voltage drops of the thirteenth transistor T13 and the fourteenth body transistor T14 are also zero.

The voltage of the first electrode of the eleventh transistor T11 is the voltage $V_{S2}$ of the second power supply voltage signal, the voltage of the second electrode of the eleventh transistor T11 is the voltage $V_{S3}$ of the third power supply voltage signal, which makes the eleventh transistor T11 bear a relatively large voltage drop. Therefore, the second power supply voltage signal will not be transmitted to the second node B through the eleventh transistor T11 and the twelfth transistor T12.

In this way, when the thirteenth transistor T13 and the fourteenth transistor T14 are in the turned-on state, even if the eleventh transistor T11 and the twelfth transistor T12 are in a transition state of neither completely turned off nor completely turned on, the second power supply voltage signal from the second power supply voltage signal terminal S2 will not be transmitted to the second node B through the eleventh transistor T11 and the twelfth transistor T12. That is, the second power supply voltage signal will not affect the second node B. As a result, the voltage of the second node B may be maintained at exactly the voltage of the third power supply voltage signal, and the gate voltage of the first transistor T1 may be controlled at exactly the voltage $V_{S3}$ of the third power supply voltage signal.

When the voltage of the third node M is the high voltage, due to action of the potential control sub-circuit 204, the voltage of the second node B is the low voltage. In this case, the P-type first transistor T1 is in the turned-on state under control of the low voltage of the third power supply voltage signal.

Since the tenth transistor T10 is turned on in response to the enable signal received from the enable signal terminal EM, the first transistor T1 is connected to the element to be driven L. As a result, the driving current from the signal control sub-circuit 10 is transmitted to the element to be driven L to drive the element to be driven L to work.

At an end time of the working period, the enable signal input from the enable signal terminal EM changes from a low voltage to a high voltage, the fourth transistor T4, the fifth transistor T5, the ninth transistor T9, and the tenth transistor T10 are turned off at the same time, and thus the element to be driven L does not work. Therefore, for pixel driving circuits connected to the same enable signal line, the elements to be driven L connected to the pixel driving circuits may be turned on at different times, but are turned off at the same time. Thus, by controlling a turn-on time of the first transistor T1, it may be possible to control a duration during which the driving current is transmitted to the element to be driven L, and thus control the working time of the element to be driven L.

It will be noted that, since the voltage of the second power supply voltage signal and the voltage of the third power supply voltage signal determine whether the first transistor T1 is turned on, in an example where the first transistor T1 is the P-type transistor, the voltage of the second power supply voltage signal needs to ensure that the first transistor T1 is completely turned off in each image frame, and the voltage of the third power supply voltage signal needs to ensure that the first transistor T1 is completely turned on in each image frame.

As for a driving process of the pixel driving circuits in sub-pixel regions from the second row to the n-th row in the working period (P5~P6), reference may be made to the driving process of the pixel driving circuits in the first row of sub-pixel regions in the working period (P5~P6), and details will not be repeated here.

Figure 8:
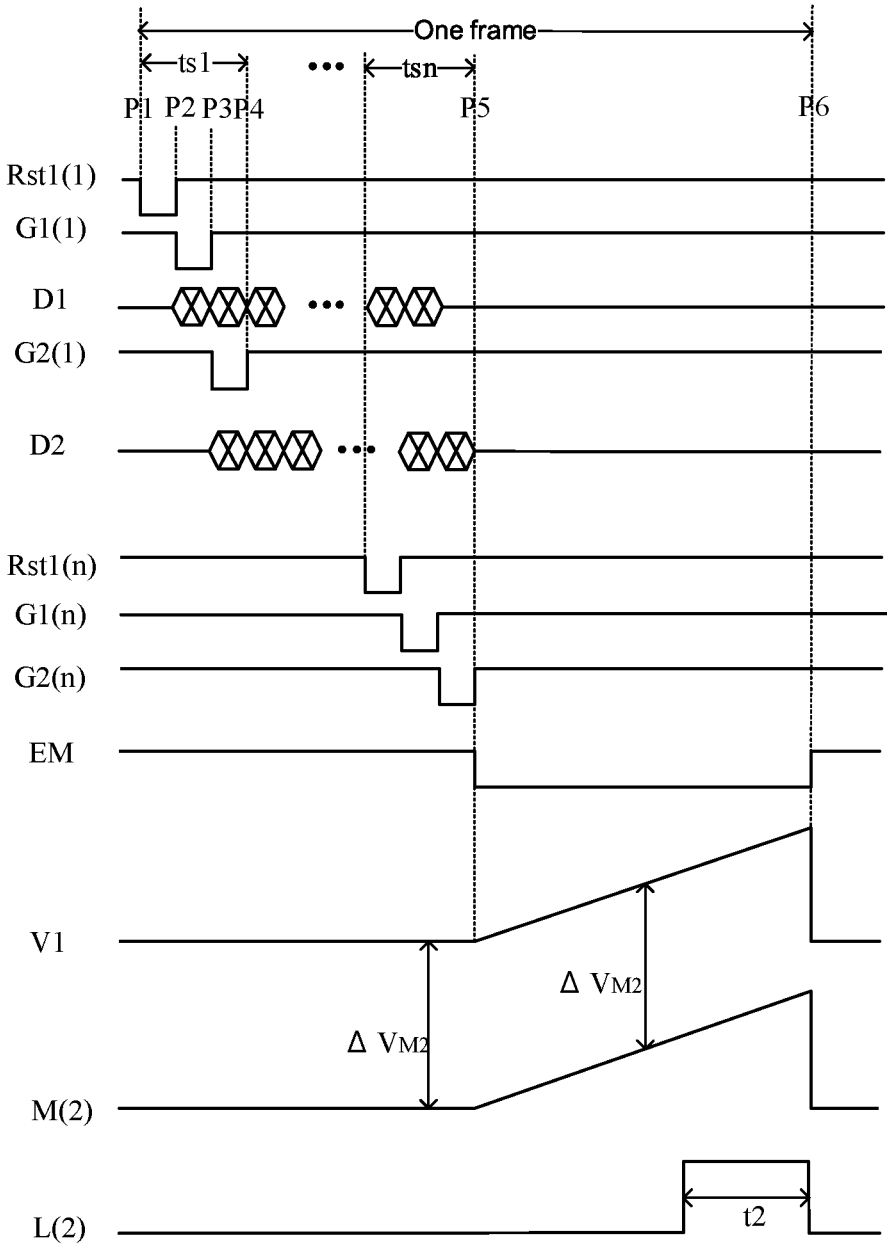
FIG. 8 is another timing diagram of the pixel driving circuit, in accordance with some embodiments of the present disclosure.

FIGS. 7 and 8 illustrate timings of the same pixel driving circuit in two image frames and working times of the element to be driven L connected to the pixel driving circuit. M(1) in FIG. 7 indicates a signal timing of the third node M in an image frame, and the voltage (denoted as $V_{M1}$) of the third node M is obtained by subtracting a variation $\Delta V_{M1}$ from the voltage $V_{V1}$ of the first voltage signal. That is, the voltage of the third node M is: $V_{M1}=V_{V1}-\Delta V_{M1}$, which may be transformed to: $\Delta V_{M1}=V_{V1}-V_{M1}$. As mentioned above, $V_{M1}=V_{V2}-V_{data2}+V_{V1}$, then, $\Delta V_{M1}=V_{data2}-V_{V2}$. M(2) in FIG. 8 indicates a signal timing of the third node M in another image frame, and the voltage (denoted as $V_{M2}$) of the third node M is obtained by subtracting a variation $\Delta V_{M2}$ from the voltage $V_{V1}$ of the first voltage signal. That is, the voltage of the third node M is: $V_{M2}=V_{V1}-\Delta V_{M2}$, which may be transformed to: $\Delta V_{M2}=V_{V1}-V_{M2}$. As mentioned above, $V_{M2}=V_{V2}-V_{data2}+V_{V1}$, then, $\Delta V_{M2}=V_{data2}-V_{V2}$. In a case where the voltage $V_{data2}$ of the second data signal provided by the second data signal terminal D2 is different in the two image frames, the values of $\Delta V_{M2}$ and $\Delta V_{M1}$ are also different. In this case, if the value of $\Delta V_{M2}$ is greater than that of $\Delta V_{M1}$, in the pixel driving circuit shown in FIG. 5, a duration during which the voltage $V_{M2}$ of the third node M changes to a value that can control the third power supply voltage signal to be transmitted by the potential control sub-circuit 20 to the second node B is longer than a duration during which the voltage $V_{M1}$ of the third node M changes to a value that can control the third power supply voltage signal to be transmitted by the potential control sub-circuit 20 to the second node B. That is, the first transistor T1 in the image frame shown in FIG. 7 is turned on earlier than the first transistor T1 in the image frame shown in FIG. 8. Therefore, the element to be driven L(1) in the image frame shown in FIG. 7 is turned on earlier than the element to be driven L(2) in the image frame shown in FIG. 8. As a result, a light-emitting duration t1 of the element to be driven L(1) is longer than a light-emitting duration t2 of the element to be driven L(2).

As shown in FIG. 6, in a case where the eleventh transistor T11, the twelfth transistor T12, and the fifteenth transistor T15 are all N-type transistors, and the thirteenth transistor T13, the fourteenth transistor T14, and the sixteenth transistor T16 are all ID-type transistors, the voltage of the second power supply voltage signal provided by the second power supply voltage signal terminal S2 is a low voltage, and the voltage of the third power supply voltage signal provided by the third power supply voltage signal terminal S3 is a high voltage.

On this basis, when the voltage of the third node M controls the thirteenth transistor T13 and the fourteenth transistor T14 to be turned on, the third power supply voltage signal from the third power supply voltage signal terminal S3 is transmitted to the first electrode of the fourteenth transistor T14 through the thirteenth transistor T13, and is then transmitted to the second node B through the second electrode of the fourteenth transistor T14, so that the voltage of the second node B becomes the voltage $V_{S3}$ of the third power supply voltage signal.

Since the voltage of the third power supply voltage signal is the high voltage, the fifteenth transistor T15 is turned on, and transmits the third power supply voltage signal provided by the third power supply voltage signal terminal S3 to the second electrode of the eleventh transistor T11 and the first electrode of the twelfth transistors T12, so that the voltage of the second electrode of the eleventh transistor T11 and the voltage of the first electrode of the twelfth transistor T12 both become the voltage $V_{S3}$ of the third power supply voltage signal.

Since the second electrode of the twelfth transistor T12 is connected to the second node B, the voltage of the second electrode of the twelfth transistor T12 is the voltage $V_{S3}$ of the third power supply voltage signal. That is, the voltage of the first electrode of the twelfth transistor T12 and the voltage of the second electrode of the twelfth transistor T12 are both the voltage $V_{S3}$ of the third power supply voltage signal. In this case, the voltage drop of the twelfth transistor T12 is zero. The voltage drops of the thirteenth transistor T13 and the fourteenth transistor T14 are also zero.

The voltage of the first electrode of the eleventh transistor T11 is the voltage $V_{S2}$ of the second power supply voltage signal provided by the second power supply voltage signal terminal S2, and the voltage of the second electrode of the eleventh transistor T11 is the voltage $V_{S3}$ of the third power supply voltage signal, which makes the eleventh transistor T11 bear a large voltage drop. Therefore, the second power supply voltage signal will not be transmitted to the second node B through the eleventh transistor T11 and the twelfth transistor T12.

In this way, when the thirteenth transistor T13 and the fourteenth transistor T14 are in the turned-on state, even if the eleventh transistor T11 and the twelfth transistor T12 are in a transition state of neither completely turned off nor completely turned on, the second power supply voltage signal from the second power supply voltage signal terminal S2 will not be transmitted to the second node B through the eleventh transistor T11 and the twelfth transistor T12. That is, the second power supply voltage signal will not affect the second node B. As a result, the voltage of the second node B may be maintained at exactly the voltage of the third power supply voltage signal, and the gate voltage of the first transistor T1 may be controlled at exactly the voltage $V_{S3}$ of the third power supply voltage signal.

In this case, the P-type first transistor T1 is in the turned-off state under control of the high voltage of the third power supply voltage signal, and thus the element to be driven L does not work.

When the voltage of the third node M changes, as the voltage of the first voltage signal changes, to a value that can control the eleventh transistor T11 and the twelfth transistor T12 to be turned on, the second power supply voltage signal from the second power supply voltage signal terminal S2 is transmitted to the first electrode of the twelfth transistor T12 through the eleventh transistor T11, and is then transmitted to the second node B through the second electrode of the twelfth transistor T12, so that the voltage of the second node B becomes the voltage $V_{S2}$ of the second power supply voltage signal.

Since the voltage of the second power supply voltage signal is the low voltage, the sixteenth transistor T16 is turned on, and transmits the second power supply voltage signal provided by the second power supply voltage signal terminal S2 to the second electrode of the thirteenth transistor T13 and the first electrode of the fourteenth transistor T14, so that the voltage of the second electrode of the thirteenth transistor T13 and the voltage of the first electrode of the fourteenth transistor T14 both become the voltage $V_{S2}$ of the second power supply voltage signal.

Since the second electrode of the fourteenth transistor T14 is connected to the second node B, the voltage of the second electrode of the fourteenth transistor T14 is the voltage $V_{S2}$ of the second power supply voltage signal. That is, the voltage of the first electrode of the fourteenth transistor T14 and the voltage of the second electrode of the fourteenth transistor T14 are both the voltage $V_{S2}$ of the second power supply voltage signal. In this case, the voltage drop of the fourteenth transistor T14 is zero. The voltage drops of the eleventh transistor T11 and the twelfth transistor T12 are also zero.

The voltage of the first electrode of the thirteenth transistor T13 is the voltage $V_{S3}$ of the third power supply voltage signal provided by the third power supply voltage signal terminal S3, and the voltage of the second electrode of the thirteenth transistor T13 is the voltage of the second power supply voltage signal $V_{S2}$, which makes the thirteenth transistor T13 bear a large voltage drop. Therefore, the third power supply voltage signal will not be transmitted to the second node B through the thirteenth transistor T13 and the fourteenth transistor T14.

In this way, when the eleventh transistor T11 and the twelfth transistor T12 are in the turned-on state, even if the fourteenth transistor T14 and the thirteenth transistor T13 are in a transition state of neither completely turned off nor completely turned on, the third power supply voltage signal from the third power supply voltage signal terminal S3 will not be transmitted to the second node B through the thirteenth transistor T13 and the fourteenth transistor T14. That is, the third power supply voltage signal will not affect the second node B. As a result, the voltage of the second node B may be maintained at exactly the voltage of the second power supply voltage signal, and the gate voltage of the first transistor T1 may be controlled at exactly the voltage $V_{S2}$ of the second power supply voltage signal.

In this case, the P-type first transistor T1 is in the turned-on state under control of the low voltage of the second power supply voltage signal. Since the fifth transistor T5 and the tenth transistor T10 are turned on in response to the enable signal received from the enable signal terminal EM, the first transistor T1 is connected to the element to be driven L, and the driving signal from the signal control sub-circuit 10 is transmitted to the element to be driven L to drive the element to be driven L to work.

Therefore, by controlling the turn-on time of the first transistor T1, it may be possible to control a duration during which the driving signal is transmitted to the element to be driven L, and thus control the working time of the element to be driven L.

Figure 9:
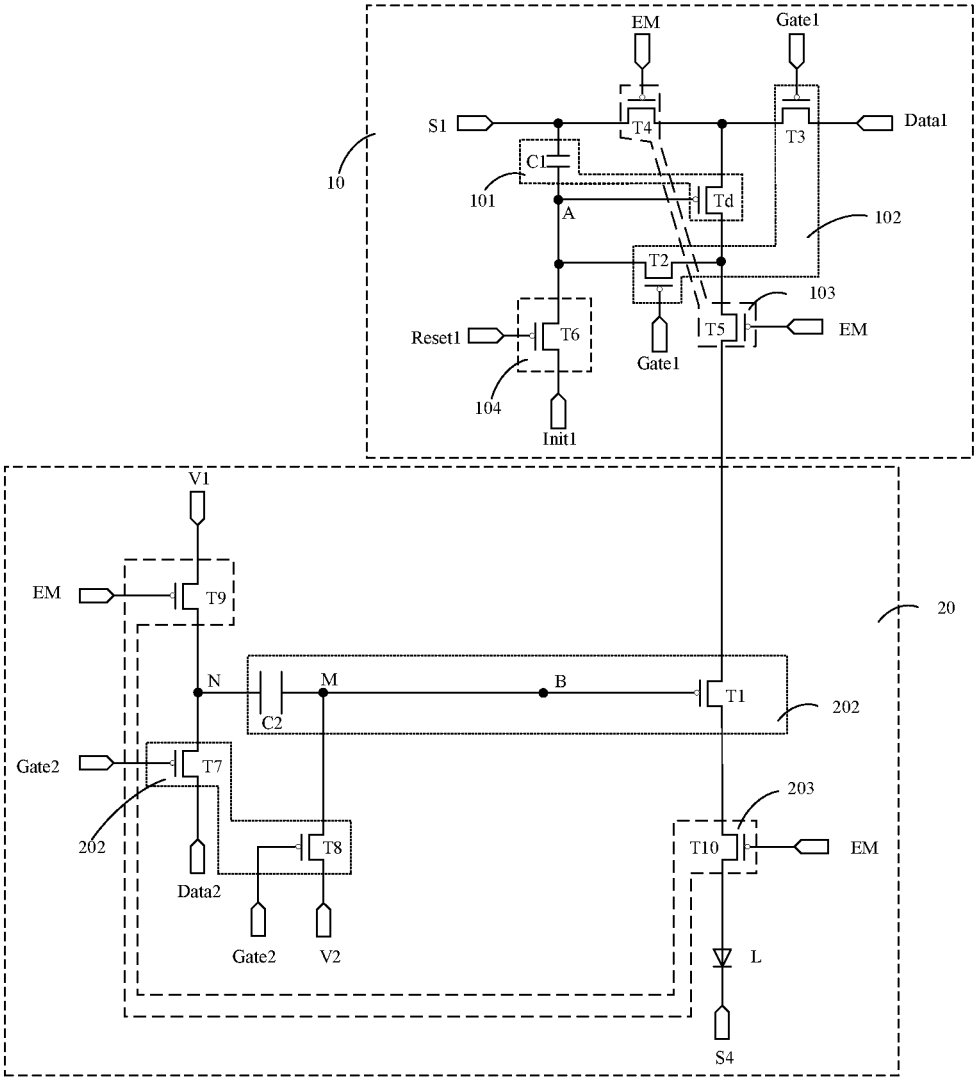
FIG. 9 is a circuit diagram of a pixel driving circuit in the related art.

In the pixel driving circuit shown in FIG. 9, the third node M is directly connected to the gate of the first transistor T1, so that the gate voltage of the first transistor T1 is equal to the voltage ($V_{V2}-V_{data2}+V_{V1}$) of the third node M. The voltage of the first voltage signal provided by the first voltage signal terminal V1 changes within the set voltage range, so that the gate voltage of the first transistor T1 changes as $V_{V1}$ changes. When the gate voltage of the first transistor T1 changes to a value close to the threshold voltage of the first transistor T1, due to the manufacturing process, the gate voltage of the first transistor T1 will be neither a high voltage nor a low voltage, which causes the first transistor T1 to be in a transition state of neither completely turned off nor completely turned on. In this case, when the element to be driven L needs to display a grayscale under a driving signal with a relatively high value, the first transistor T1 in the transition state will transmit a driving signal with a relatively low value to the element to be driven L, so that the element to be driven L works under the driving signal with the relatively low value. Consequently, not only the turn-on time (and thus the working time) of the element to be driven L cannot be accurately controlled, but also the uniformity of the grayscale display will decrease and color shift will occur.

Figure 10:
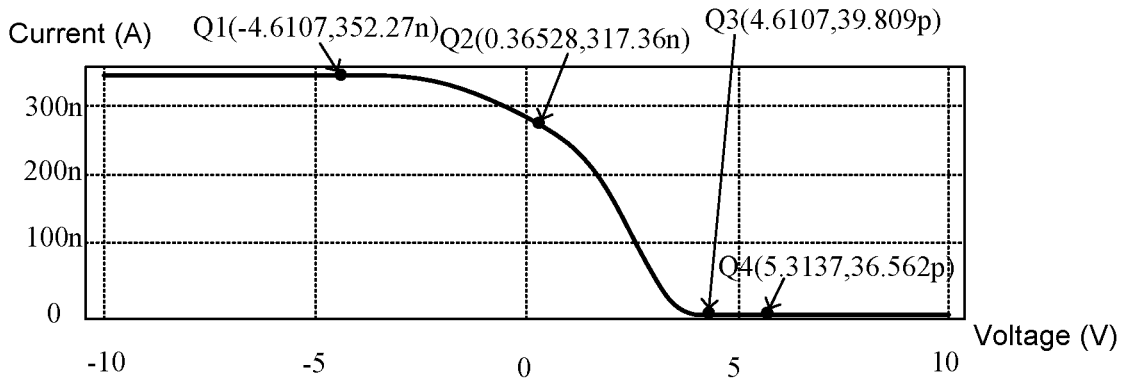
FIG. 10 is a simulation test diagram of the pixel driving circuit shown in FIG. 9.

A simulation test is performed on the pixel driving circuit in FIG. 9 and a test result is shown in FIG. 10, where a horizontal axis represents a voltage of the gate of the first transistor T1, and a vertical axis represents a driving current input to the element to be driven L. A voltage range of the gate of the first transistor T1 (that is, the third node M) is −10V to 10V, Q1 and Q4 represent a highest point and a lowest point of the voltage of the gate of the first transistor T1 respectively; and Q2 and Q3 represent situations in which the voltage of the gate of the first transistor T1 is neither a high voltage nor a low voltage. In a process where the voltage of the gate of the first transistor T1 gradually changes as the voltage of the first voltage signal changes, it can be seen from FIG. 10 that, there may be situations where the voltage of the gate of the first transistor T1 is neither a high voltage nor a low voltage. In this case, the voltage of the gate of the first transistor T1 is neither a high voltage nor a low voltage, which causes the first transistor T1 to be in the transition state of neither completely turned off nor completely turned on. Consequently, the element to be driven L that should have stopped working will continue to work at a relatively low current density, which causes the element to be driven L to be in a lower current density state for a period of time and reduces the uniformity of grayscale display.

Figure 11:
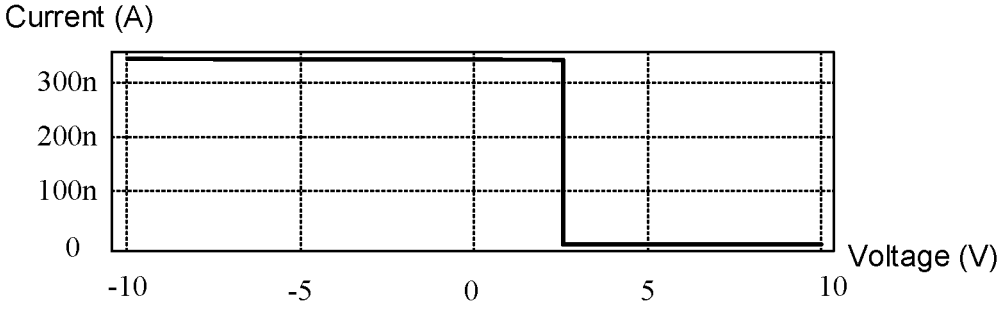
FIG. 11 is a simulation test diagram of a pixel driving circuit, in accordance with some embodiments of the disclosure.

A simulation test is performed on the pixel driving circuit in FIG. 5, and a test result is shown in FIG. 11, wherein a horizontal axis represents a voltage of the second node B (i.e., the gate of the first transistor T1), and a vertical axis represents a driving current input to the element to be driven L. In a process where the voltage of the third node M changes as the voltage of the first voltage signal changes, it can be seen from FIG. 11 that, the second node B is at a high voltage and a low voltage in different periods, and will not be at a voltage that is neither a high voltage nor a low voltage as in FIG. 10. In this case, when the element to be driven L performs grayscale display, it may be possible to accurately control the first transistor T1 to be turned on or turned off, and thus the driving current of the element to be driven L is maintained as the driving current from the signal control sub-circuit 10. In this way, the uniformity of grayscales and the stability of color coordinates may be ensured.

Figure 12:
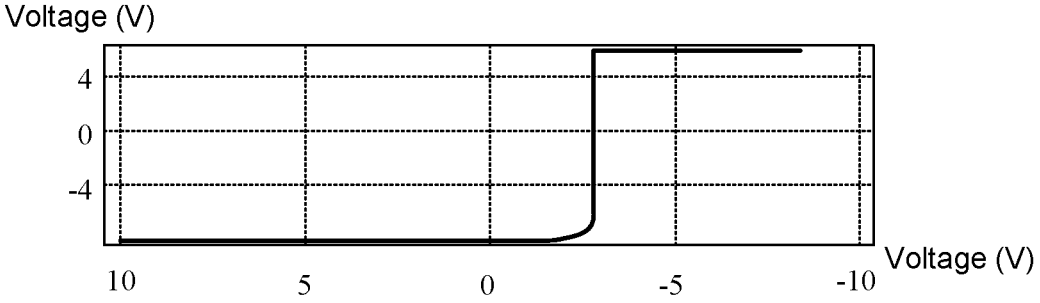
FIG. 12 is another simulation test diagram of the pixel driving circuit, in accordance with some embodiments of the present disclosure.

A simulation test is performed on the pixel driving circuit in FIG. 5, and a test result is shown in FIG. 12, where a horizontal axis represents a voltage of the third node M, and a vertical axis represents a voltage of the second node B. It can be seen from FIG. 12 that, when the voltage of the third node M gradually changes from a high voltage to a low voltage, the voltage of the second node B abruptly changes from a low voltage to a high voltage, and the second node B only maintains at a low voltage or a high voltage, but will not be at a voltage that is neither a high voltage nor a low voltage state. Therefore, a signal that is neither a high voltage signal nor a low voltage signal may be converted into a high voltage signal or a low voltage signal through the potential control sub-circuit 204. As a result, it may be possible to control the first transistor T1 to be in completely turned on or completely turned off, and thus realize accurate control of the working time of the element to be driven L.

In summary, by controlling the voltage of the second node B to be the voltage of the second power supply voltage signal or the voltage of the third power supply voltage signal, and by controlling the voltage of the second node B to be either a high voltage or a low voltage, it may be possible to accurately control the first transistor T1 to be turned on or turned off, and thus realize accurate control of the working time of the driving element L. When the element to be driven L displays different grayscales, by controlling a magnitude of the driving signal of the element to be driven L and a light-emitting duration of the element to be driven L, it may be possible to change a luminance of the element to be driven L, thereby realizing corresponding grayscale display and improving a display effect of the display panel.

Some embodiments of the present disclosure further provide a driving method for the pixel driving circuit described above. As shown in FIG. 7, a period of a single frame includes a scanning period (P1~P5) and a working period (P5~P6). The scanning period (P1~P5) includes a plurality of row scanning periods (ts1~tsn). The driving method includes steps 10 to 20 (S10~S20) in each row scanning period, and steps 30 to 40 (S30~40) in the working period.

The driving method includes the following steps.

In S10, the signal control sub-circuit 10 writes at least the first data signal from the first data signal terminal D1 into the first node A, in response to the first scan signal received from the first scan signal terminal G1.

In S20, the time control sub-circuit 20 writes the second data signal from the second data signal terminal D2 into the fourth node N, and writes the second voltage signal from the second voltage signal terminal V2 into the third node M, in response to the second scan signal received from the second scan signal terminal G2.

In S30, the signal control sub-circuit 10 enables the first driving sub-circuit 101 to output the driving signal to the first transistor T1 according to the first data signal provided by the first data signal terminal D1 and the first power supply voltage signal provided by the first power supply voltage signal terminal S1, in response to the enable signal received from the enable signal terminal EM.

In S40, the time control sub-circuit 20 writes the first voltage signal that changes within the set voltage range provided by the first voltage signal terminal into the fourth node N, in response to the enable signal received from the enable signal terminal EM, so that the voltage on the third node M changes as the voltage difference between the first voltage signal and the second data signal changes; and the time control sub-circuit 20 transmits the second power supply voltage signal provided by the second power supply voltage signal terminal S2 and the third power supply voltage signal provided by the third power supply voltage signal terminal S3 to the second node B in different periods, in response to the voltage change on the third node M, so as to control the turn-on time of the first transistor T1 and thus control a working time of the element to be driven L.

In some embodiments, referring to FIG. 4, the signal control sub-circuit 10 includes the first driving sub-circuit 101, the first data writing sub-circuit 102, and the first control sub-circuit 103. The first driving sub-circuit 101 includes the driving transistor Td, and the gate of the driving transistor Td is connected to the first node A. The first data writing sub-circuit 102 is connected to the first scan signal terminal G1, the first data signal terminal D1, and the driving transistor Td. The first control sub-circuit 103 is connected to the enable signal terminal EM, the first power supply voltage signal terminal S1, the driving transistor Td, and the first electrode of the first transistor T1.

The above S10 and S30 include steps 101 and 301 (S101 and S301), respectively.

In S101, the first data writing sub-circuit 102 writes the first data signal from the first data signal terminal D1 and the threshold voltage of the driving transistor Td into the first node A, in response to the first scan signal received from the first scan signal terminal G1, so as to perform threshold voltage compensation on the driving transistor Td.

In S301, the first control sub-circuit 103 enables the driving transistor Td to be connected to the first power supply voltage signal terminal S1 and the first electrode of the first transistor T1, in response to the enable signal received from the enable signal terminal EM; and the driving transistor Td outputs the driving signal to the first electrode of the first transistor T1 according to the first data signal provided by the first data signal terminal D1 and the first power supply voltage signal provided by the first power supply voltage signal terminal S1.

In some other embodiments, referring to FIG. 4, the time control sub-circuit 20 includes the second data writing sub-circuit 202, the second driving sub-circuit 201, the second control sub-circuit 203 and the potential control sub-circuit 204. The second driving sub-circuit 201 includes the first transistor T1 and the second capacitor C2. The gate of the first transistor T1 is connected to the second node B, and the first electrode of the first transistor T1 is connected to the signal control sub-circuit 10. One terminal of the second capacitor C2 is connected to the third node M, and the other terminal of the second capacitor C2 is connected to the fourth node N. The second data writing sub-circuit 202 is connected to the second scan signal terminal G2, the second data signal terminal D2, the second voltage signal terminal V2, the third node M, and the fourth node N. The second control sub-circuit 203 is connected to the enable signal terminal EM, the first voltage signal terminal V1, the second electrode of the first transistor T1, the fourth node N, and the element to be driven L. The potential control sub-circuit 204 is connected to the second node B, the third node M, the second power supply voltage signal terminal S2, and the third power supply voltage signal terminal S3.

The above S20 and S40 include steps 201 and 401 (S201 and S401), respectively.

In S201, the second data writing sub-circuit 202 writes the second data signal from the second data signal terminal D2 into the fourth node N, and writes the second voltage signal from the second voltage signal terminal V2 into the third node M, in response to the second scan signal received from the second scan signal terminal G2.

In S401, the second control sub-circuit 203 writes the first voltage signal from the first voltage signal terminal V1 into the fourth node N, in response to the enable signal received from the enable signal terminal EM, so that the voltage on the third node M changes as the voltage difference between the first voltage signal and the second data signal changes; the second control sub-circuit 203 enables the second electrode of the first transistor T1 to be connected to the element to be driven L, in response to the enable signal received from the enable signal terminal EM; and the potential control sub-circuit 204 transmits the second power supply voltage signal provided by the second power supply voltage signal terminal S2 and the third power supply voltage signal provided by the third power supply voltage signal terminal S3 to the second node B in different periods, in response to the voltage change on the third node M.

The driving method for the pixel driving circuit provided in some embodiments of the present disclosure has the same beneficial effects as the pixel driving circuit described above, and details will not be repeated here.

On this basis, in some embodiments of the present disclosure, referring to FIG. 4, the signal control sub-circuit 10 further includes the reset sub-circuit 104. The reset sub-circuit 104 is connected to the initial signal terminal Init1, the reset signal terminal Rst1 and the first node A. The driving method further includes step 00 (S00) in each row scanning period.

The driving method further includes the following process.

In S00, in the first period (P1~P2) shown in FIG. 7, the reset sub-circuit 104 transmits the initial signal provided by the initial signal terminal Init1 to the first node A, in response to the reset signal received from the reset signal terminal Rst1.

In some examples, as shown in FIG. 5, the reset sub-circuit 104 includes the sixth transistor T6. The gate of the sixth transistor T6 is connected to the reset signal terminal Rst1, the first electrode of the sixth transistor T6 is connected to the initial signal terminal Init1, and the second electrode of the sixth transistor T6 is connected to the first node A.

The above S00 includes step 01 (S01).

In S01, the sixth transistor T6 is turned on, and transmits the initial signal provided by the initial signal terminal Init1 to the first node A, in response to the reset signal received from the reset signal terminal Rst1, so as to reset the voltage of the first node A to the voltage $V_{init1}$ of the initial signal.

In this case, since the other terminal of the first capacitor C1 and the gate of the driving transistor Td are both connected to the first node A, the voltage of the other terminal of the first capacitor C1 and the gate voltage of the driving transistor Td are both reset to $V_{init1}$.

The foregoing descriptions are merely specific implementations of the present disclosure, but the protection scope of the present disclosure is not limited thereto. Any person skilled in the art could conceive of changes or replacements within the technical scope of the present disclosure, which shall be included in the protection scope of the present disclosure. Therefore, the protection scope of the present disclosure shall be subject to the protection scope of the claims.

What is claimed is:

1. A pixel driving circuit, comprising:

a signal control sub-circuit connected to a first scan signal terminal, a first data signal terminal, a first power supply voltage signal terminal, and an enable signal terminal, wherein the signal control sub-circuit includes a first driving sub-circuit, and the first driving sub-circuit is connected to a first node; and the signal control sub-circuit is configured to: write at least a first data signal provided by the first data signal terminal into the first node, in response to a first scan signal received from the first scan signal terminal; and enable the first driving sub-circuit to output a driving signal according to the first data signal provided by the first data signal terminal and a first power supply voltage signal provided by the first power supply voltage signal terminal, in response to an enable signal received from the enable signal terminal;

a time control sub-circuit connected to a second scan signal terminal, a second data signal terminal, the enable signal terminal, a first voltage signal terminal, a second voltage signal terminal, a second power supply voltage signal terminal, a third power supply voltage signal terminal, the signal control sub-circuit and an element to be driven, wherein the time control sub-circuit includes a second driving sub-circuit, and the second driving sub-circuit includes a first transistor; the second driving sub-circuit is connected to a second node, a third node, and a fourth node, and the first transistor is connected to the second node and the signal control sub-circuit; the time control sub-circuit is configured to: write a second data signal provided by the second data signal terminal into the fourth node, and write a second voltage signal provided by the second voltage signal terminal into the third node, in response to a second scan signal received from the second scan signal terminal; write a first voltage signal that changes within a set voltage range provided by the first voltage signal terminal into the fourth node, in response to the enable signal received from the enable signal terminal, so that a voltage on the third node changes as a voltage difference between the first voltage signal and the second data signal changes; and transmit a second power supply voltage signal provided by the second power supply voltage signal terminal and a third power supply voltage signal provided by the third power supply voltage signal terminal to the second node in different periods, in response to a change of the voltage on the third node, so as to control a turn-on time of the first transistor, and transmit the driving signal to the element to be driven when the first transistor is turned on.

2. The pixel driving circuit according to claim 1, wherein the signal control sub-circuit further includes a first data writing sub-circuit and a first control sub-circuit; the first driving sub-circuit includes a driving transistor, and a gate of the driving transistor is connected to the first node;

the first data writing sub-circuit is connected to the first scan signal terminal, the first data signal terminal, and the driving transistor; the first data writing sub-circuit is configured to write the first data signal and a threshold voltage of the driving transistor into the first node, in response to the received first scan signal, so as to perform threshold voltage compensation on the driving transistor;

the first control sub-circuit is connected to the enable signal terminal, the first power supply voltage signal terminal, the driving transistor, and a first electrode of the first transistor; the first control sub-circuit is configured to enable the driving transistor to be connected to the first power supply voltage signal terminal and the first electrode of the first transistor, in response to the received enable signal;

the first driving sub-circuit is further connected to the first power supply voltage signal terminal; and the driving transistor is configured to output the driving signal to the first electrode of the first transistor according to the first data signal and the first power supply voltage signal.

3. The pixel driving circuit according to claim 2, wherein the first driving sub-circuit further includes a first capacitor;

one terminal of the first capacitor is connected to the first power supply voltage signal terminal, and another terminal of the first capacitor is connected to the first node.

4. The pixel driving circuit according to claim 2, wherein the first data writing sub-circuit includes a second transistor and a third transistor;

a gate of the second transistor is connected to the first scan signal terminal, a first electrode of the second transistor is connected to a second electrode of the driving transistor, and a second electrode of the second transistor is connected to the first node;

a gate of the third transistor is connected to the first scan signal terminal, a first electrode of the third transistor is connected to the first data signal terminal, and a second electrode of the third transistor is connected to a first electrode of the driving transistor.

5. The pixel driving circuit according to claim 2, wherein the first control sub-circuit includes a fourth transistor and a fifth transistor;

a gate of the fourth transistor is connected to the enable signal terminal, a first electrode of the fourth transistor is connected to the first power supply voltage signal terminal, and a second electrode of the fourth transistor is connected to the first electrode of the driving transistor; and a gate of the fifth transistor is connected to the enable signal terminal, a first electrode of the fifth transistor is connected to the second electrode of the driving transistor, and a second electrode of the fifth transistor is connected to the first electrode of the first transistor.

6. The pixel driving circuit according to claim 2, wherein the signal control sub-circuit further includes a reset sub-circuit;

the reset sub-circuit is connected to an initial signal terminal, a reset signal terminal and the first node; the reset sub-circuit is configured to transmit an initial signal provided by the initial signal terminal to the first node, in response to a reset signal received from the reset signal terminal.

7. The pixel driving circuit according to claim 6, wherein the reset sub-circuit includes a sixth transistor;

a gate of the sixth transistor is connected to the reset signal terminal, a first electrode of the sixth transistor is connected to the initial signal terminal, and a second electrode of the sixth transistor is connected to the first node.

8. The pixel driving circuit according to claim 1, wherein the time control sub-circuit further includes a second data writing sub-circuit, a second control sub-circuit, and a potential control sub-circuit;

the second driving sub-circuit further includes a second capacitor; a gate of the first transistor is connected to the second node, and a first electrode of the first transistor is connected to the signal control sub-circuit; one terminal of the second capacitor is connected to the third node, and another terminal of the second capacitor is connected to the fourth node;

the second data writing sub-circuit is connected to the second scan signal terminal, the second data signal terminal, the second voltage signal terminal, the third node, and the fourth node; the second data writing sub-circuit is configured to write the second data signal into the fourth node and write the second voltage signal into the third node, in response to the received second scan signal;

the second control sub-circuit is connected to the enable signal terminal, the first voltage signal terminal, a second electrode of the first transistor, the fourth node, and the element to be driven; the second control sub-circuit is configured to write the first voltage signal into the fourth node, and enable the second electrode of the first transistor to be connected to the element to be driven, in response to the received enable signal; and the potential control sub-circuit is connected to the second node, the third node, the second power supply voltage signal terminal, and the third power supply voltage signal terminal; the potential control sub-circuit is configured to transmit the second power supply voltage signal and the third power supply voltage signal to the second node in different periods, in response to the change of the voltage on the third node.

9. The pixel driving circuit according to claim 8, wherein the second data writing sub-circuit includes a seventh transistor and an eighth transistor;

a gate of the seventh transistor is connected to the second scan signal terminal, a first electrode of the seventh transistor is connected to the second data signal terminal, and a second electrode of the seventh transistor is connected to the fourth node; and a gate of the eighth transistor is connected to the second scan signal terminal, a first electrode of the eighth transistor is connected to the second voltage signal terminal, and a second electrode of the eighth transistor is connected to the third node.

10. The pixel driving circuit according to claim 8, wherein the second control sub-circuit includes a ninth transistor and a tenth transistor;

a gate of the ninth transistor is connected to the enable signal terminal, a first electrode of the ninth transistor is connected to the first voltage signal terminal, and a second electrode of the ninth transistor is connected to the fourth node; and a gate of the tenth transistor is connected to the enable signal terminal, a first electrode of the tenth transistor is connected to the second electrode of the first transistor, and a second electrode of the tenth transistor is connected to the element to be driven.

11. The pixel driving circuit according to claim 8, wherein the potential control sub-circuit includes an eleventh transistor, a twelfth transistor, a thirteenth transistor, a fourteenth transistor, a fifteenth transistor and a sixteenth transistor;

a gate of the eleventh transistor is connected to the third node, a first electrode of the eleventh transistor is connected to the second power supply voltage signal terminal, and a second electrode of the eleventh transistor is connected to a first electrode of the twelfth transistor;

a gate of the twelfth transistor is connected to the third node, and a second electrode of the twelfth transistor is connected to the second node;

a gate of the thirteenth transistor is connected to the third node, a first electrode of the thirteenth transistor is connected to the third power supply voltage signal terminal, and a second electrode of the thirteenth transistor is connected to a first electrode of the fourteenth transistor;

a gate of the fourteenth transistor is connected to the third node, and a second electrode of the fourteenth transistor is connected to the second node;

a gate of the fifteenth transistor is connected to the second node, a first electrode of the fifteenth transistor is connected to the third power supply voltage signal terminal, and a second electrode of the fifteenth transistor is connected to the second electrode of the eleventh transistor and the first electrode of the twelfth transistor;

a gate of the sixteenth transistor is connected to the second node, a first electrode of the sixteenth transistor is connected to the second power supply voltage signal terminal, and a second electrode of the sixteenth transistor is connected to the second electrode of the thirteenth transistor and the first electrode of the fourteenth transistor;

the eleventh transistor, the twelfth transistor, and the fifteenth transistor are all P-type transistors, and the thirteenth transistor, the fourteenth transistor, and the sixteenth transistor are all N-type transistors; or, the eleventh transistor, the twelfth transistor, and the fifteenth transistor are all N-type transistors, and the thirteenth transistor, the fourteenth transistor, and the sixteenth transistor are all P-type transistors.

12. A display panel, comprising:

a plurality of pixel driving circuits according to claim 1; and a plurality of elements to be driven, each element to be driven being connected to a corresponding pixel driving circuit.

13. The display panel according to claim 12, wherein the display panel has a plurality of sub-pixel regions, and each pixel driving circuit is disposed in a single sub-pixel region; and the display panel further comprises:

a plurality of first scan signal lines, first scan signal terminals connected to pixel driving circuits in a same row of sub-pixel regions being connected to a corresponding first scan signal line;

a plurality of first data signal lines, first data signal terminals connected to pixel driving circuits in a same column of sub-pixel regions being connected to a corresponding first data signal line;

a plurality of second scan signal lines, second scan signal terminals connected to the pixel driving circuits in the same row of sub-pixel regions being connected to a corresponding second scan signal line;

a plurality of second data signal lines, second data signal terminals connected to the pixel driving circuits in the same column of sub-pixel regions being connected to a corresponding second data signal line; and a plurality of enable signal lines, enable signal terminals connected to the pixel driving circuits in the same row of sub-pixel regions being connected to a corresponding enable signal line.

14. The display panel according to claim 12, wherein the element to be driven is a current-driven light-emitting device.

15. A display device comprising the display panel according to claim 12.

16. A driving method for the pixel driving circuit according to claim 1, a period of a single frame including a scanning period and a working period, and the scanning period including a plurality of row scanning periods, the driving method comprising:

in each of the plurality of row scanning periods:

writing, by the signal control sub-circuit, at least the first data signal from the first data signal terminal into the first node, in response to the first scan signal received from the first scan signal terminal;

writing, by the time control sub-circuit, the second data signal from the second data signal terminal into the fourth node, in response to the second scan signal received from the second scan signal terminal; and writing, by the time control sub-circuit, the second voltage signal from the second voltage signal terminal into the third node, in response to the second scan signal received from the second scan signal terminal; and in the working period:

enabling, by the signal control sub-circuit, the first driving sub-circuit to output the driving signal to the first transistor according to the first data signal and the first power supply voltage signal provided by the first power supply voltage signal terminal, in response to the enable signal received from the enable signal terminal;

writing, by the time control sub-circuit, the first voltage signal that changes within the set voltage range provided by the first voltage signal terminal into the fourth node, in response to the enable signal received from the enable signal terminal, so that the voltage on the third node changes as the voltage difference between the first voltage signal and the second data signal changes; and transmitting, by the time control sub-circuit, the second power supply voltage signal provided by the second power supply voltage signal terminal and the third power supply voltage signal provided by the third power supply voltage signal terminal to the second node in different periods, in response to the change of the voltage on the third node, so as to control the turn-on time of the first transistor and thus control a working time of the element to be driven.

17. The driving method for the pixel driving circuit according to claim 16, wherein the signal control sub-circuit further includes a first data writing sub-circuit and a first control sub-circuit; the first driving sub-circuit includes a driving transistor, and a gate of the driving transistor is connected to the first node; the first data writing sub-circuit is connected to the first scan signal terminal, the first data signal terminal, and the driving transistor; the first control sub-circuit is connected to the enable signal terminal, the first power supply voltage signal terminal, the driving transistor, and a first electrode of the first transistor; and in each of the plurality of row scanning periods, writing, by the signal control sub-circuit, at least the first data signal into the first node in response to the received first scan signal, and in the working period, enabling, by the signal control sub-circuit, the first driving sub-circuit to output the driving signal to the first transistor according to the first data signal and the first power supply voltage signal in response to the received enable signal, includes:

in each of the plurality of row scanning periods:

writing, by the first data writing sub-circuit, the first data signal and a threshold voltage of the driving transistor into the first node, in response to the received first scan signal, so as to perform threshold voltage compensation on the driving transistor; and in the working period:

enabling, by the first control sub-circuit, the driving transistor to be connected to the first power supply voltage signal terminal and the first electrode of the first transistor, in response to the received enable signal; and outputting, by the driving transistor, the driving signal to the first electrode of the first transistor according to the first data signal and the first power supply voltage signal.

18. The driving method for the pixel driving circuit according to claim 16, wherein the time control sub-circuit further includes a second data writing sub-circuit, a second control sub-circuit, and a potential control sub-circuit; the second driving sub-circuit further includes a second capacitor; a gate of the first transistor is connected to the second node, and a first electrode of the first transistor is connected to the signal control sub-circuit; one terminal of the second capacitor is connected to the third node, and another terminal of the second capacitor is connected to the fourth node; the second data writing sub-circuit is connected to the second scan signal terminal, the second data signal terminal, the second voltage signal terminal, the third node, and the fourth node; the second control sub-circuit is connected to the enable signal terminal, the first voltage signal terminal, a second electrode of the first transistor, the fourth node, and the element to be driven; the potential control sub-circuit is connected to the second node, the third node, the second power supply voltage signal terminal, and the third power supply voltage signal terminal; and in each of the plurality of row scanning periods, writing, by the time control sub-circuit, the second data signal into the fourth node, in response to the received second scan signal; and writing, by the time control sub-circuit, the second voltage signal into the third node, in response to the received second scan signal; and in the working period, writing, by the time control sub-circuit, the first voltage signal into the fourth node, in response to the received enable signal, so that the voltage on the third node changes as the voltage difference between the first voltage signal and the second data signal changes; and transmitting, by the time control sub-circuit, the second power supply voltage signal and the third power supply voltage signal to the second node in different periods, in response to the change of the voltage on the third node, includes:

in each of the plurality of row scanning periods:

writing, by the second data writing sub-circuit, the second data signal into the fourth node, in response to the received second scan signal; and writing, by the second data writing sub-circuit, the second voltage signal into the third node, in response to the received second scan signal; and in the working period:

writing, by the second control sub-circuit, the first voltage signal into the fourth node, in response to the received enable signal, so that the voltage on the third node changes as the voltage difference between the first voltage signal and the second data signal changes; and enabling, by the second control sub-circuit, the second electrode of the first transistor to be connected to the element to be driven, in response to the received enable signal; and transmitting, by the potential control sub-circuit, the second power supply voltage signal and the third power supply voltage signal to the second node in different periods, in response to the change of the voltage on the third node.

19. The pixel driving circuit according to claim 1, wherein the signal control sub-circuit further includes a first data writing sub-circuit and a first control sub-circuit;

the first driving sub-circuit includes a driving transistor and a first capacitor; a gate of the driving transistor is connected to the first node; one terminal of the first capacitor is connected to the first power supply voltage signal terminal, and another terminal of the first capacitor is connected to the first node;

the first data writing sub-circuit includes a second transistor and a third transistor; a gate of the second transistor is connected to the first scan signal terminal, a first electrode of the second transistor is connected to a second electrode of the driving transistor, and a second electrode of the second transistor is connected to the first node; a gate of the third transistor is connected to the first scan signal terminal, a first electrode of the third transistor is connected to the first data signal terminal, and a second electrode of the third transistor is connected to a first electrode of the driving transistor;

the first control sub-circuit includes a fourth transistor and a fifth transistor; a gate of the fourth transistor is connected to the enable signal terminal, a first electrode of the fourth transistor is connected to the first power supply voltage signal terminal, and a second electrode of the fourth transistor is connected to the first electrode of the driving transistor; and a gate of the fifth transistor is connected to the enable signal terminal, a first electrode of the fifth transistor is connected to the second electrode of the driving transistor, and a second electrode of the fifth transistor is connected to the first electrode of the first transistor.

20. The pixel driving circuit according to claim 1, wherein the time control sub-circuit further includes a second data writing sub-circuit, a second control sub-circuit, and a potential control sub-circuit;

the second driving sub-circuit further includes a second capacitor; a gate of the first transistor is connected to the second node, and a first electrode of the first transistor is connected to the signal control sub-circuit; one terminal of the second capacitor is connected to the third node, and another terminal of the second capacitor is connected to the fourth node;

the second data writing sub-circuit includes a seventh transistor and an eighth transistor; a gate of the seventh transistor is connected to the second scan signal terminal, a first electrode of the seventh transistor is connected to the second data signal terminal, and a second electrode of the seventh transistor is connected to the fourth node; a gate of the eighth transistor is connected to the second scan signal terminal, a first electrode of the eighth transistor is connected to the second voltage signal terminal, and a second electrode of the eighth transistor is connected to the third node;

the second control sub-circuit includes a ninth transistor and a tenth transistor; a gate of the ninth transistor is connected to the enable signal terminal, a first electrode of the ninth transistor is connected to the first voltage signal terminal, and a second electrode of the ninth transistor is connected to the fourth node; a gate of the tenth transistor is connected to the enable signal terminal, a first electrode of the tenth transistor is connected to a second electrode of the first transistor, and a second electrode of the tenth transistor is connected to the element to be driven;

the potential control sub-circuit includes an eleventh transistor, a twelfth transistor, a thirteenth transistor, a fourteenth transistor, a fifteenth transistor and a sixteenth transistor; a gate of the eleventh transistor is connected to the third node, a first electrode of the eleventh transistor is connected to the second power supply voltage signal terminal, and a second electrode of the eleventh transistor is connected to a first electrode of the twelfth transistor; a gate of the twelfth transistor is connected to the third node, and a second electrode of the twelfth transistor is connected to the second node; a gate of the thirteenth transistor is connected to the third node, a first electrode of the thirteenth transistor is connected to the third power supply voltage signal terminal, and a second electrode of the thirteenth transistor is connected to a first electrode of the fourteenth transistor; a gate of the fourteenth transistor is connected to the third node, and a second electrode of the fourteenth transistor is connected to the second node; a gate of the fifteenth transistor is connected to the second node, a first electrode of the fifteenth transistor is connected to the third power supply voltage signal terminal, and a second electrode of the fifteenth transistor is connected to the second electrode of the eleventh transistor and the first electrode of the twelfth transistor; a gate of the sixteenth transistor is connected to the second node, a first electrode of the sixteenth transistor is connected to the second power supply voltage signal terminal, and a second electrode of the sixteenth transistor is connected to the second electrode of the thirteenth transistor and the first electrode of the fourteenth transistor, wherein the eleventh transistor, the twelfth transistor, and the fifteenth transistor are all P-type transistors, and the thirteenth transistor, the fourteenth transistor, and the sixteenth transistor are all N-type transistors; or the eleventh transistor, the twelfth transistor, and the fifteenth transistor are all N-type transistors, and the thirteenth transistor, the fourteenth transistor, and the sixteenth transistor are all P-type transistors.

* * * * *